US009885974B2

(12) United States Patent
Sato et al.

(10) Patent No.: US 9,885,974 B2
(45) Date of Patent: Feb. 6, 2018

(54) DEVELOPING CARTRIDGE, PROCESS CARTRIDGE AND IMAGE FORMING APPARATUS

(71) Applicant: CANON KABUSHIKI KAISHA, Tokyo (JP)

(72) Inventors: Kensuke Sato, Yokohama (JP); Masaaki Sato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/371,681

(22) Filed: Dec. 7, 2016

(65) Prior Publication Data

US 2017/0090343 A1 Mar. 30, 2017

Related U.S. Application Data

(62) Division of application No. 14/737,975, filed on Jun. 12, 2015, now Pat. No. 9,529,298.

(30) Foreign Application Priority Data

Jun. 17, 2014 (JP) ..... 2014-124478

(51) Int. Cl.
*G03G 15/08* (2006.01)

(52) U.S. Cl.
CPC ..... *G03G 15/0812* (2013.01); *G03G 15/0865* (2013.01)

(58) Field of Classification Search
CPC ..... G03G 15/0812–15/0818; G03G 21/1867; G03G 15/0921; G03G 21/1676;
(Continued)

(56) References Cited

U.S. PATENT DOCUMENTS 5,331,373 A 7/1994 Nomura et al.
5,452,056 A 9/1995 Nomura et al.
(Continued)

FOREIGN PATENT DOCUMENTS

JP 2000-214681 A 8/2000
JP 2000275955 A 10/2000
JP 2011154239 A 8/2011

OTHER PUBLICATIONS

Search Report in European Patent Application No. 15172245.1, dated Nov. 24, 2015.
(Continued)

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

A developing cartridge includes a developing roller 210*d* that develops, by way of a developer, an electrostatic latent image that is formed on an image bearing member 207; a developer regulating member that regulates the thickness of a developer carried on the developing roller 210*d*; and a frame 214*a* that rotatably supports the developing roller 210*d* and supports the developer regulating member. The frame 214*a* has a developing roller support section 214*a*1 that rotatably supports an outer peripheral face 210*d*6 of at least one end of the developing roller 210*d*. The developing roller support section 214*a*1 has a clearance at a position that, when viewed in the axial direction of the developing roller 210*d*, overlaps a contact region at which the developing roller 210*d* is in contact with the image bearing member 207.

4 Claims, 29 Drawing Sheets

(58) Field of Classification Search
CPC ..... G03G 21/1814; G03G 2215/0855; G03G 2215/0872; G03G 2221/1654
See application file for complete search history.

(56) References Cited

U.S. PATENT DOCUMENTS

| | | | |
|---|---|---|---|
| 5,528,341 | A | 6/1996 | Shishido et al. |
| 5,585,889 | A | 12/1996 | Shishido et al. |
| 5,606,397 | A | 2/1997 | Honda et al. |
| 5,870,654 | A | 2/1999 | Sato et al. |
| 5,911,096 | A | 6/1999 | Batori et al. |
| 5,940,658 | A | 8/1999 | Yokoi et al. |
| 5,966,566 | A | 10/1999 | Odagawa et al. |
| 5,974,288 | A | 10/1999 | Sato |
| 6,075,957 | A | 6/2000 | Batori et al. |
| 6,104,894 | A | 8/2000 | Sato et al. |
| 6,131,007 | A | 10/2000 | Yamaguchi et al. |
| 6,185,390 | B1 | 2/2001 | Higeta et al. |
| 6,188,856 | B1 | 2/2001 | Sato |
| 6,212,343 | B1 | 4/2001 | Hosokawa et al. |
| 6,381,420 | B1 | 4/2002 | Sato et al. |
| 6,640,066 | B2 | 10/2003 | Sato |
| 6,714,749 | B2 | 3/2004 | Sato et al. |
| 6,895,199 | B2 | 5/2005 | Sato et al. |
| 6,898,399 | B2 | 5/2005 | Morioka et al. |
| 6,937,832 | B2 | 8/2005 | Sato et al. |
| 7,149,457 | B2 | 12/2006 | Miyabe et al. |
| 7,155,140 | B2 | 12/2006 | Arimitsu et al. |
| 7,155,141 | B2 | 12/2006 | Sato et al. |
| 7,158,736 | B2 | 1/2007 | Sato et al. |
| 7,200,349 | B2 | 4/2007 | Sato et al. |
| 7,218,882 | B2 | 5/2007 | Toba et al. |
| 7,224,925 | B2 | 5/2007 | Sato et al. |
| 7,283,766 | B2 | 10/2007 | Arimitsu et al. |
| 7,349,657 | B2 | 3/2008 | Sato et al. |
| 7,412,193 | B2 | 8/2008 | Sato et al. |
| 7,499,663 | B2 | 3/2009 | Sato et al. |
| 7,660,550 | B2 | 2/2010 | Mori et al. |
| 7,689,146 | B2 | 3/2010 | Sato et al. |
| 7,720,408 | B2 | 5/2010 | Ueno et al. |
| 7,813,668 | B2 | 10/2010 | Ueno et al. |
| 9,134,696 | B2 | 9/2015 | Sato et al. |
| 9,152,076 | B2 | 10/2015 | Nishida |
| 2005/0254862 | A1 | 11/2005 | Toba et al. |
| 2006/0008289 | A1 | 1/2006 | Sato et al. |
| 2009/0022523 | A1 | 1/2009 | Kadota et al. |
| 2011/0013933 | A1 | 1/2011 | Sato |
| 2011/0103834 | A1 | 5/2011 | Toba et al. |
| 2011/0182627 | A1 | 7/2011 | Shiraki et al. |
| 2011/0222903 | A1 | 9/2011 | Kishi |
| 2011/0255897 | A1 | 10/2011 | Sato |
| 2011/0305482 | A1 | 12/2011 | So |
| 2012/0177401 | A1 | 7/2012 | Nishida |
| 2012/0201577 | A1 | 8/2012 | Sakamaki et al. |
| 2013/0004211 | A1 | 1/2013 | Ishii et al. |
| 2013/0028630 | A1 | 1/2013 | Ito et al. |
| 2013/0071148 | A1 | 3/2013 | Ishikura et al. |
| 2013/0147122 | A1 | 6/2013 | Shoji et al. |
| 2013/0259514 | A1 | 10/2013 | McCoy et al. |
| 2013/0287431 | A1 | 10/2013 | Fukamachi et al. |
| 2013/0322921 | A1 | 12/2013 | Maeshima et al. |
| 2013/0330099 | A1 | 12/2013 | Gutierrez et al. |
| 2014/0064778 | A1 | 3/2014 | Uneme |
| 2014/0072327 | A1 | 3/2014 | Hayashi et al. |
| 2014/0153958 | A1 | 6/2014 | Ogata et al. |
| 2014/0153960 | A1 | 6/2014 | Handa et al. |
| 2014/0178094 | A1 | 6/2014 | Kanai et al. |
| 2014/0270842 | A1 | 9/2014 | Gonzalez |
| 2014/0321887 | A1 | 10/2014 | Matsumoto et al. |
| 2015/0050041 | A1 | 2/2015 | Yamagishi |
| 2015/0093146 | A1 | 4/2015 | Sato et al. |
| 2015/0139683 | A1 | 5/2015 | Yasui |
| 2015/0227110 | A1 | 8/2015 | Yoshimura et al. |
| 2015/0253691 | A1 | 9/2015 | Mitsui et al. |

OTHER PUBLICATIONS

Communication in European Patent Application No. 15172245.1, dated Apr. 12, 2016.

DEVELOPING CARTRIDGE, PROCESS CARTRIDGE AND IMAGE FORMING APPARATUS

BACKGROUND OF THE INVENTION

Field of the Invention

The present invention relates to a developing cartridge, a process cartridge and an image forming apparatus.

Description of the Related Art

Solid metal shafts produced through machining of steel materials have been used conventionally as metal cores of developing rollers (developer bearing members) that are utilized in image forming apparatuses; however, hollow cylindrical shaft members have been proposed (Japanese Patent Application Publication Nos. 2000-275955 and 2011-154239) in order to reduce material costs. As a configuration for rotatably supporting such cylindrical shafts on a frame, Japanese Patent Application Publication Nos. 2000-275955 and 2011-154239 disclose a configuration in which a bearing member is assembled on the inner periphery of the end of a cylindrical shaft, and the bearing member is supported on a frame, as a result of which the cylindrical shaft becomes rotatably supported on the frame.

SUMMARY OF THE INVENTION

Herein, the developing roller is required to be placed precisely in the attachment position to the frame, due to the fluctuation of toner carrying amount caused by positional precision between the developing roller and the developing blade (developer regulating member). In the configuration disclosed in Japanese Patent Application Publication Nos. 2000-275955 and 2011-154239, a developing roller is supported by assembling a bearing member to the inner periphery of an end of the developing roller. In order to achieve attachment position precisely, it is necessary to increase at least the dimensional precision of a developer regulating member, an outer peripheral face of the developing roller, an inner peripheral face of the developing roller, and the dimensional precision of a bearing member. This arises from the significant influence that dimensional precision among these constituent components exerts on attachment position precision of the developing roller. However, larger production costs are likely to be incurred when increasing thus the dimensional precision. Production costs, moreover, rise in proportion to the number of components.

Therefore, it is an object of the present invention to provide, for instance, a developing cartridge that supports a developing roller, with a simple configuration, while preserving attachment position precision.

To attain the above goal, a developing cartridge of the present invention is a developing cartridge, comprising:

a developing roller that develops, by way of a developer, an electrostatic latent image that is formed on an image bearing member;

a developer regulating member that regulates a thickness of developer carried on the developing roller; and a frame that rotatably supports the developing roller, and supports the developer regulating member, wherein the frame has a developing roller support section that rotatably supports an outer peripheral face of at least one end of the developing roller, and the developing roller support section has a clearance at a position that, when viewed in an axial direction of the developing roller, overlaps a contact region at which the developing roller is in contact with the image bearing member.

To attain the above goal, a process cartridge of the present invention is a process cartridge for performing an image formation process of forming an image on a recording material by way of a developer, the process cartridge being configured to be detachably attached to an apparatus body of an image forming apparatus, the process cartridge comprising:

the developing cartridge.

To attain the above goal, an image forming apparatus of the present invention is an image forming apparatus for forming an image on a recording material by way of a developer, comprising:

the developing cartridge, or the process cartridge.

The present invention allows providing, for instance, a developing cartridge that supports a developing roller, with a simple configuration, while preserving attachment position precision.

Further features of the present invention will become apparent from the following description of exemplary embodiments with reference to the attached drawings.

DESCRIPTION OF THE EMBODIMENTS

The following provides a detailed exemplary explanation of embodiments of this invention based on examples with reference to the drawings. However, the dimensions, materials, shapes and relative arrangement of constituent components described in the embodiments may be suitably modified according the configuration and various conditions of the apparatus to which the invention is applied. Namely, the scope of this invention is not intended to be limited to the following embodiments.

Embodiment 1

A developing cartridge (developing assembly), a process cartridge and an image forming apparatus according to Embodiment 1 of the present invention will be explained with reference to FIG. 1 to FIG. 6. Herein, the term image forming apparatus (for example electrophotographic image forming apparatus) refers to an apparatus in which an image is formed on a recording material, by developer (for example toner), in accordance with an electrophotographic image formation process. Examples of the image forming apparatus include, for instance, electrophotographic copiers, electrophotographic printers (LED printers, laser beam printers and the like), electrophotographic fax machines and electrophotographic word processors, as well as multifunction machines (multifunction printers) of the foregoing. The term recording material denotes a material on which an image is formed, for instance a recording medium such as recording paper, OHP sheets, plastic sheets and fabrics.

The term process cartridge denotes a member resulting from integrating, in the form of a cartridge, an image bearing member (for example electrophotographic photoconductive drum) and at least one from among a charging device, developing means and cleaning means, as process means that act on the electrophotographic photoconductive drum. The process cartridge is configured to be detachably attached to the body of the image forming apparatus. The term developing cartridge refers to a cartridge in which developing means, such as a developing roller (developer bearing member) and a developing blade (developer regulating member), for developing a latent image on an electrophotographic photoconductive drum, are integrated together with a developing frame that supports the developing means, such that the cartridge can be attached to and detached from the apparatus body of the image forming apparatus. In the explanation below, the term image forming apparatus body (hereafter referred to as "apparatus body") denotes an apparatus constituent portion that results from excluding at least one of the process cartridge and the developing cartridge from the configuration of the apparatus body.

(Image Forming Apparatus)

Figure 2:
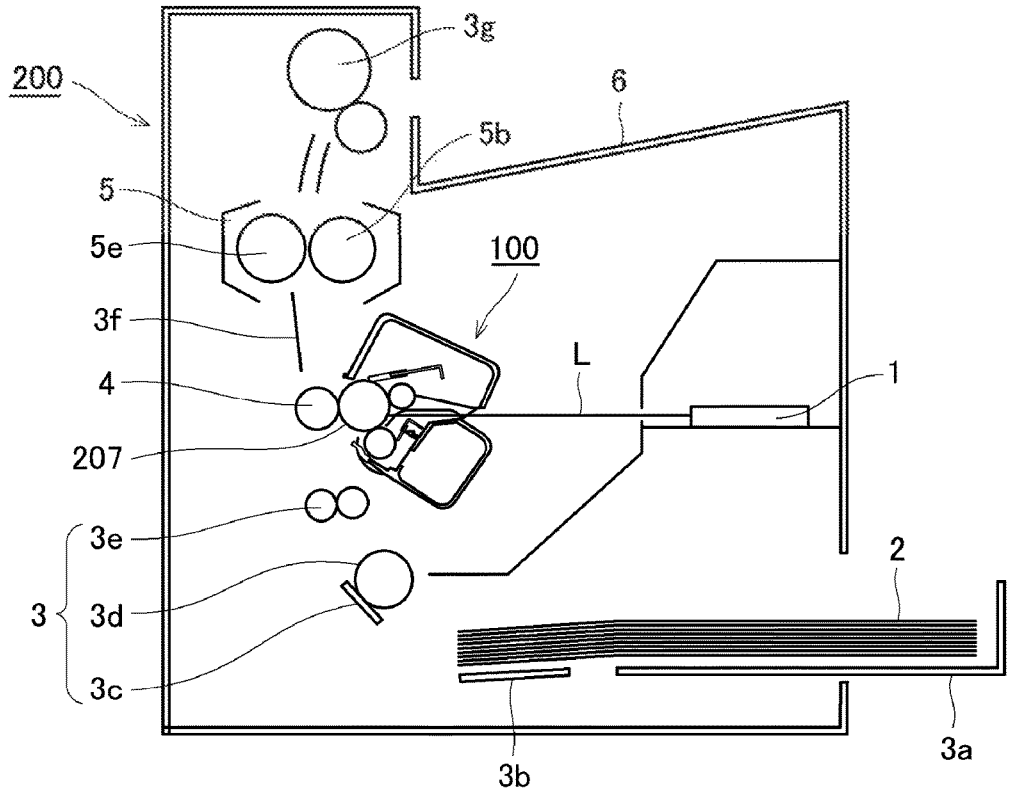
FIG. 2 is a schematic cross-sectional diagram of an image forming apparatus according to an embodiment of the present invention.

FIG. 2 is a schematic sectional diagram illustrating the schematic configuration of an image forming apparatus (laser beam printer) 200 according to an embodiment of the present invention. In the image forming apparatus 200 according to the present embodiment, as illustrated in FIG. 2, a laser beam L that is based on image information is irradiated, from an optical system 1, onto the surface of a photoconductive drum 207, being a drum-shaped electrophotographic member, to form a latent image thereby. The electrostatic latent image is developed with toner (developer), to form a toner image. Synchronously with formation of the toner image, a lift-up plate 3*b* at the leading end of a paper feed tray 3*a* that accommodates a recording medium 2 is raised, and the recording medium 2 is transported by transport means 3 that is formed of, for instance, a transport roller 3*d*, a separating pad 3*c*, and resist rollers 3*e*. Thereafter, the toner image formed on the photoconductive drum 207 that is provided in a process cartridge 100 is transferred to the recording medium 2, through application of voltage of reverse polarity to that of the toner image, to a transfer roller 4, as transfer means. The recording medium 2 is transported, by a transport guide 3*f*, to fixing means 5. The fixing means 5, which is formed from a driver roller 5*e* and a fixing roller 5*b* having a heater built thereinto, applies heat and pressure to the passing recording medium 2, to fix thereby the transferred toner image. The recording medium 2 is then transported by an output roller 3*g*, and is output at an output section 6.

(Process Cartridge and Developing Cartridge)

Figure 3:
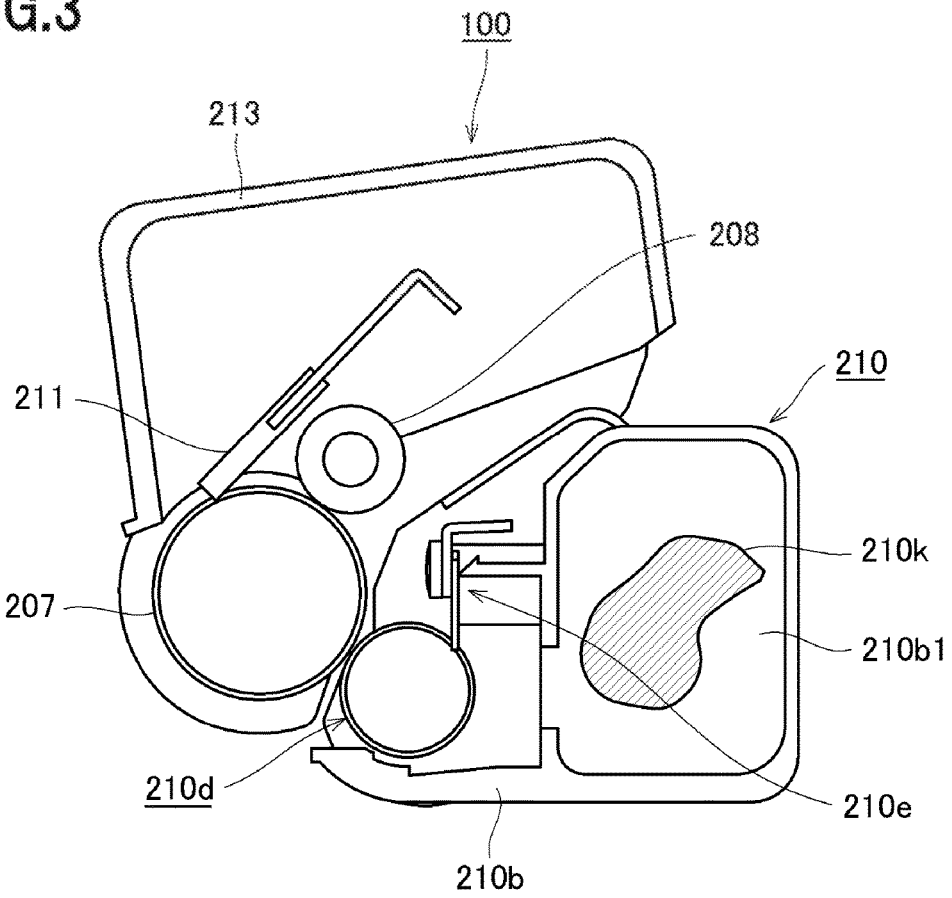
FIG. 3 is a schematic cross-sectional diagram of a process cartridge according to an embodiment of the present invention.

FIG. 3 is a schematic cross-sectional diagram illustrating the schematic configuration of the process cartridge 100 according to an embodiment of the present invention. The process cartridge 100 according to the present embodiment is provided with the photoconductive drum 207 and at least one process means. The process means includes, for instance, charging means 208 for charging the surface of the photoconductive drum 207, a developing roller 210*d* being developing means for forming a toner image on the photoconductive drum 207, and cleaning means 211 for removing residual toner from the photoconductive drum 207.

The process cartridge 100 according to the present embodiment results from arranging the charging means 208 and the cleaning means 211 around the photoconductive drum 207, and integrating, in the form of a cartridge, the cleaning frame 213, the developing roller 210*d* and so forth. In the process cartridge 100 according to the present embodiment, a developing roller 210*d*, a developing blade 210*e*, and a developer storing container (developer container) 210*b*1 are further integrated into a developing cartridge 210. The above various structures of the developing cartridge 210 that is built into the process cartridge 100 are integrated together by the developing frame 210*b*. The developing roller 210*d*, which is rotatably provided in the developing cartridge 210, is a developer bearing member for carrying and transporting toner 210*k*, which is the developer inside a developer storing container 210*b*1, to the photoconductive drum 207.

The developing roller may be a developing sleeve, and may have a magnet disposed within a hollow of the developing sleeve. A magnetic developer is used in this case, but a non-magnetic developer, or a two-component developer may be used, depending on the configuration of the developing roller.

The developing roller 210*d* is rotatably supported on the developing frame 210*b*, via a bearing member that is described below. The toner 210*k* that is supplied from the developer storing container 210*b*1 adheres to the outer peripheral face of the developing roller 210*d*. The adhered toner 210*k* is regulated to a given layer thickness by the developing blade 210*e*, being a developer regulating member, and becomes charged by being subjected to friction. Thereafter, the charged toner 210*k* on the developing roller 210*d* is transported, accompanying the rotation of the developing roller 210*d*, to a position opposite the latent image on the photoconductive drum 207. Thereafter, a predetermined developing bias is applied to the developing roller 210*d*, as a result of which the latent image on the photoconductive drum 207 is developed through adhesion of the toner 210*k* thereonto.

(Support Configuration of the Developing Roller and the Developing Blade in the Developing Cartridge)

Figure 4:
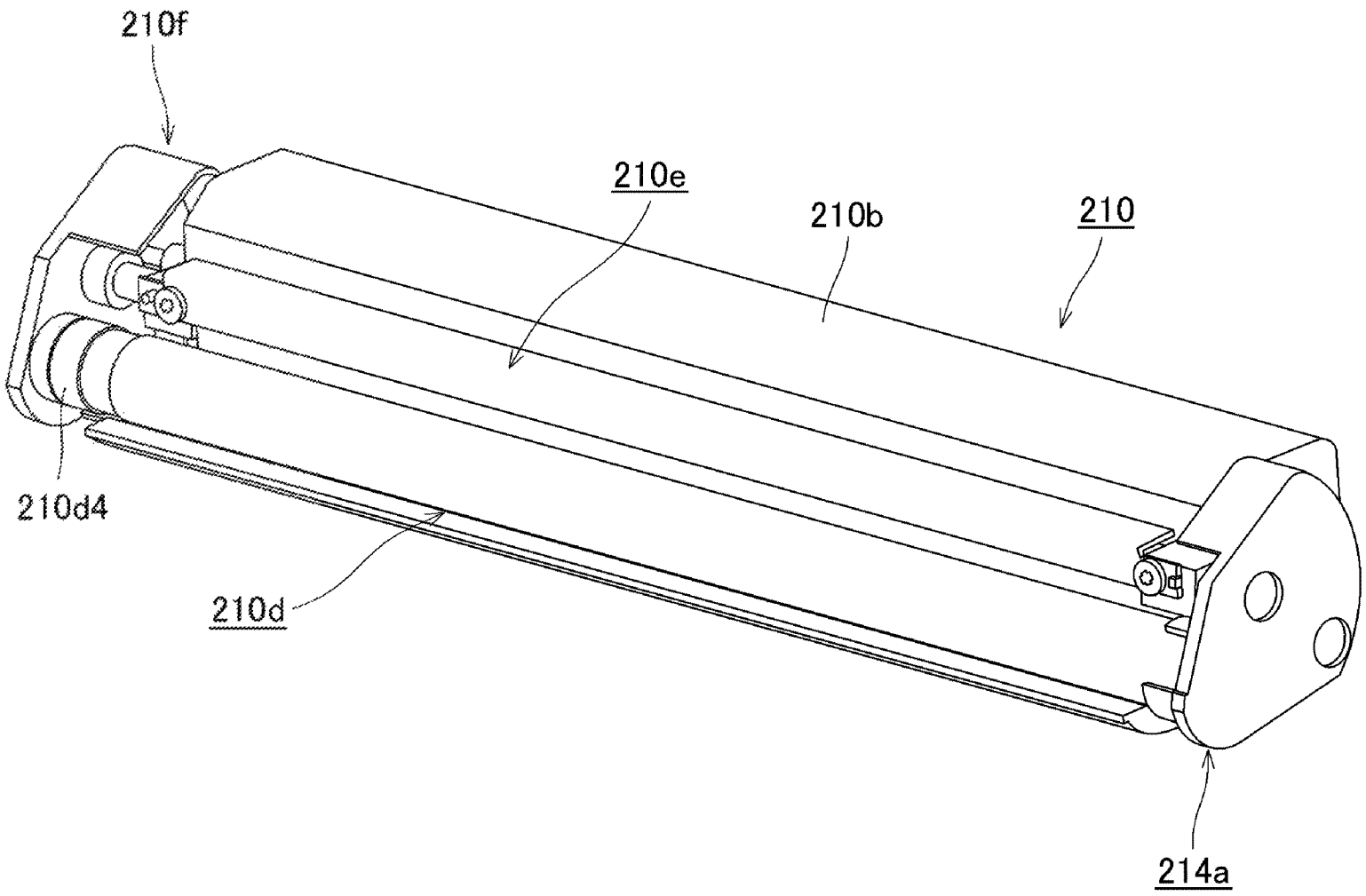
FIG. 4 is a perspective-view diagram of the developing cartridge according to Embodiment 1 of the present invention.
Figure 5:
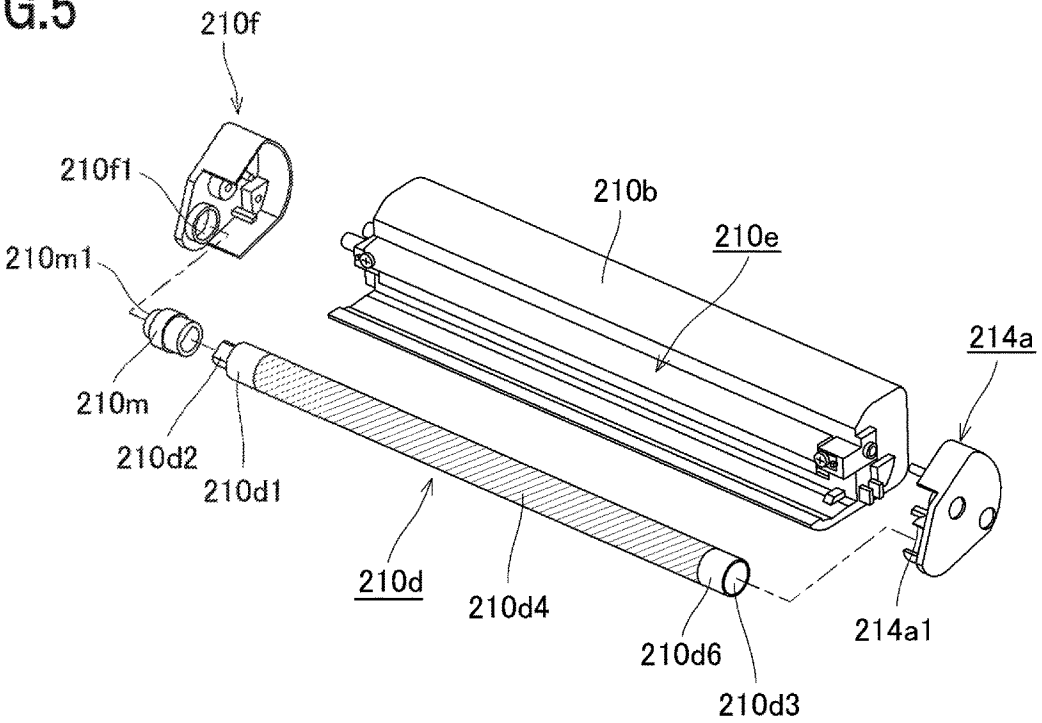
FIG. 5 is a perspective-view diagram of the developing cartridge according to Embodiment 1 of the present invention.

FIG. 4 and FIG. 5 are perspective-view diagrams for explaining a support configuration of the developing roller 210*d* and the developing blade 210*e* in the developing cartridge 210. FIG. 4 is a diagram illustrating the various structures integrated together, and FIG. 5 is a diagram illustrating the various structures in an exploded view. The side of a driven-side bearing member 210*f* in FIG. 4 and FIG. 5 is defined herein as a driven side, and the side of a non-driven-side bearing member 214*a* is defined herein as a non-driven side.

As illustrated in FIG. 5, the developing roller 210*d* has a cylindrical roller body 210*d*1. Further, the developing roller 210*d* has an engagement section 210*d*2 on one end side (driven-side) of the developing roller 210*d* in the axial direction, and an open section 210*d*3 at which an inner peripheral section of the roller body is exposed, on the other end side (non-driven side) of the developing roller 210*d*. The developing roller 210*d* has, at the center in the axial direction, a developer transport section 210*d*4 that transports the developer. The open section 210*d*3 and the developer transport section 210*d*4 may be configured such that part of a same cylindrical shape is formed as the open section 210*d*3, and another part is formed as the developer transport section 210*d*4, as illustrated in FIG. 5. In this case, the open section 210*d*3 and the developer transport section 210*d*4 adopt a shape such that there is no difference in level from the open section 210*d*3 up to the developer transport section 210*d*4. As illustrated in FIG. 4, the developing blade 210*e* is attached to the developing frame 210*b*. By coming into contact with the developer transport section 210*d*4, the developing blade 210*e* regulates, to a given thickness, the layer thickness of the toner 210*k* that is carried by the developer transport section 210*d*4. Accordingly, it is important to position the developer transport section 210*d*4 and the developing blade 210*e*, with respect to each other, with good precision, in order to regulate the layer thickness or the toner 210*k* to constant value, and to impart charge stably.

As illustrated in FIG. 5, the engagement section 210*d*2 that is provided at the end, on the driven side, of the developing roller 210*d* (roller body 210*d*1) engages with a developing roller gear 210*m* for imparting rotational driving force to the developing roller 210*d*. A rotating support section 210*m*1 of the developing roller gear 210*m* is rotatably supported on a gear support section 210*f*1 of the driven-side bearing member 210*f*. That is, the developing roller 210*d* is rotatably supported on the driven-side bearing member 210*f* via the developing roller gear 210*m*. The driven-side bearing member 210*f* is attached to the developing frame 210*b*.

On the non-driven side, a open section outer peripheral face 210*d*6, being an outer peripheral face of the non-driven-side end of the developing roller 210*d* (roller body 210*d*1), is rotatably supported by a developing roller support section 214*a*1 of the non-driven-side bearing member 214*a*. The non-driven-side bearing member 214*a* is attached to the developing frame 210*b* (the detailed configuration of the non-driven side of the developing roller 210*d* is described below).

Thus, the developing roller 210*d* is rotatably supported on both ends of the developing frame 210*b*, on the driven side and the non-driven side. Driving power from a driving source (motor), not shown, provided in the apparatus body, is transmitted to the developing roller gear 210*m* via a gear, not shown. The developing roller gear 210*m* rotates as a result. Therefore, the developing roller 210*d* rotates with respect to the developing frame 210*b* as a result of the rotation of the developing roller gear 210*m* to which the driving power is transmitted.

The open section outer peripheral face 210*d*6 being the outer peripheral face at the non-driven-side end of the developing roller 210*d* (roller body 210*d*1) is formed to be flush with the plane on which the developer transport section 210*d*4 is formed in the developing roller 210*d*. The open section outer peripheral face 210*d*6 and the developer transport section 210*d*4 can be mutually configured as a result with good precision. As described above, the developing blade 210*e* as well is fixed to the developing frame 210*b*. Accordingly, the developing roller 210*d* and the developing blade 210*e* become positioned with respect to each other via the developing frame 210*b*.

(Detailed Explanation of the Support Configuration of the Non-Driven Side of the Developing Roller)

Figure 1:
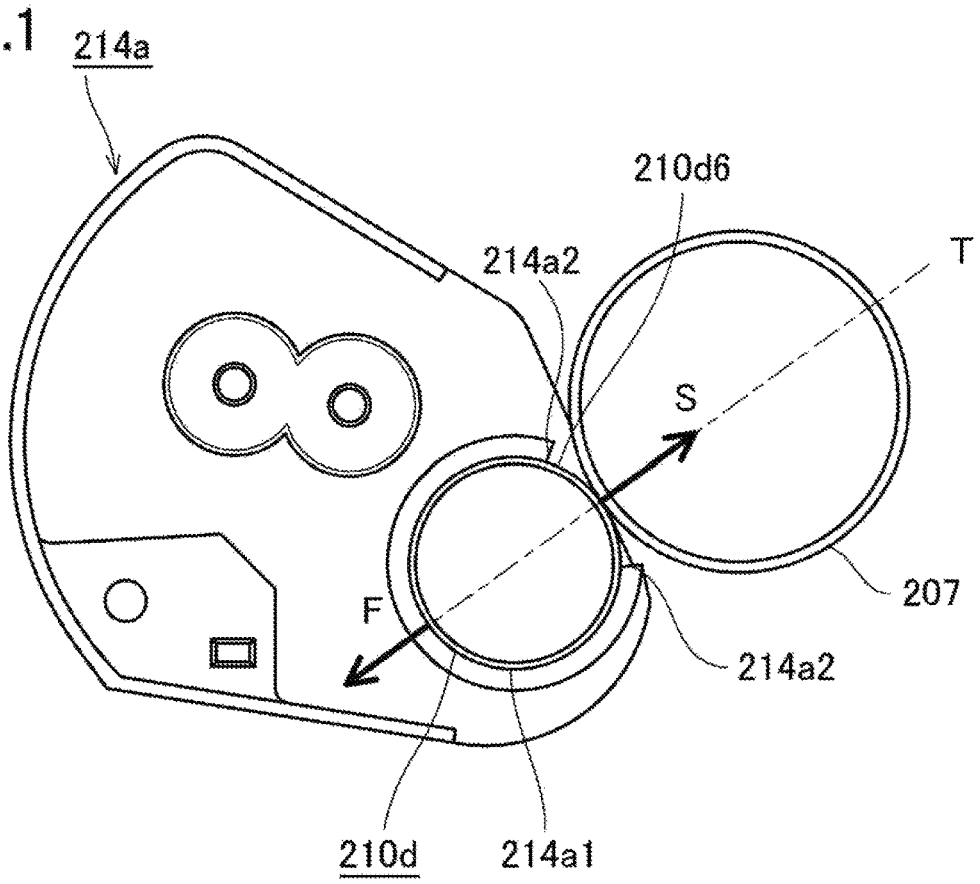
FIG. 1 is a schematic diagram illustrating the configuration of a developing cartridge according to Embodiment 1 of the present invention.
Figure 6:
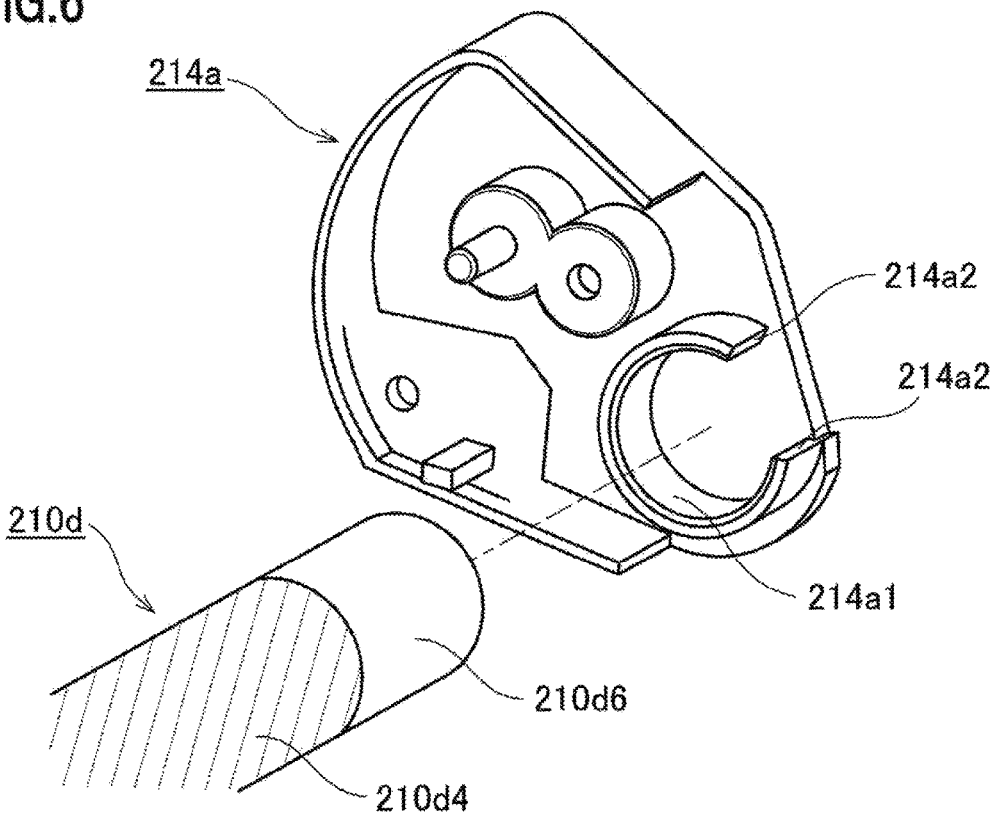
FIG. 6 is a perspective-view diagram of part of the configuration of a developing cartridge according to Embodiment 1 of the present invention.

The support configuration of the non-driven side of the developing roller 210*d* will be explained next with reference to FIG. 1 and FIG. 6. FIG. 1 is a schematic configuration diagram of the inward side of the developing cartridge, with the non-driven side of the developing cartridge viewed along the axial direction (axis direction) of the developing roller. In FIG. 1 structures other than the non-driven-side bearing member 214*a*, the developing roller 210*d* and the photoconductive drum 207 have been omitted. FIG. 6 is a perspective-view diagram illustrating the configuration of the non-driven side of the developing cartridge in an exploded view.

As illustrated in FIG. 6, the non-driven-side bearing member 214*a* of the present embodiment has a developing roller support section 214*a*1 that supports the open section outer peripheral face 210*d*6 on the non-driven side of the developing roller 210*d*. The developing roller support section 214*a*1 is configured to fit with the open section outer peripheral face 210*d*6, with a small clearance therebetween, so that the open section outer peripheral face 210*d*6 is rotatably supported as a result. The developing roller support section 214*a*1 is configured to have a shape (cutout shape) such that part of the open section outer peripheral face 210*d*6 of the developing roller 210*d* is exposed to the exterior. That is, the developing roller support section 214*a*1 is configured to have a clearance (space). When viewed in the axial direction of the developing roller, the position of this clearance is identical to the position at which the developing roller and the photoconductive drum are in contact, as made apparent in FIG. 1. The developing roller support section 214*a*1 may be formed of a conductive resin or the like, and may be electrically connected to the developing roller. In particular, a surface portion of the developing roller support section may be formed of a conductive resin and be in contact with the developing roller.

The developing roller support section 214*a*1 is configured so as not to come into contact with the photoconductive drum 207 and so as to surround part of, but not the entire circumference of, the open section outer peripheral face 210*d*6 of the developing roller 210*d*, at a position that avoids the contact section between the developing roller 210*d* and the photoconductive drum 207. Specifically, the position at which the developing roller 210*d* is supported overlaps the contact region between the developing roller 210*d* and the photoconductive drum 207, as viewed from the axial direction of the developing roller 210*d*, but is spaced apart from the contact region in the peripheral direction of the developing roller 210*d*. Similarly, the developing roller support section 214*a*1 is configured so that, when viewed in the axial direction of the developing roller 210*d*, the developing roller support section 214*a*1 has a cutout at a position overlapping the contact region between the developing roller 210*d* and the photoconductive drum 207.

FIG. 1 illustrates the positional relationship with respect to the photoconductive drum 207, on the non-driven side of the developing roller 210*d*. As illustrated in FIG. 1, a force S in the direction a line T that joins the center of the photoconductive drum 207 and the center of the developing roller 210*d* acts on the photoconductive drum 207 and the developing roller 210*d*, whereby the latter are urged to be in pressure-contact with each other. As a result, the non-driven-side bearing member 214*a* is acted upon by a force F, in the opposite direction to that of the force S, along the line T, from the developing roller 210*d* on the non-driven-side bearing member 214*a*, at the developing roller support section 214*a*1. The developing roller support section 214*a*1 has escape ends 214*a*2 that oppose the photoconductive drum 207, in the peripheral direction, across a gap. A non-contact region (non-support region) between the escape ends 214*a*2 is spaced from a position at which the developing roller support section 214*a*1 is acted upon by the force F from the developing roller 210*d* (position on the opposite side), and does not influence the support state of the developing roller 210*d*.

As described above, the support configuration of the developing roller 210*d* of the present embodiment provides support to the outer peripheral face on the non-driven side of the developing roller 210*d*. By adopting thus a configuration in which the outer peripheral face of the developing roller 210*d* is directly supported on the developing frame 210*b*, it becomes possible to position and support the developing blade 210*e* with good precision, even without maintaining the dimensional precision of the inner face of the developing roller 210*d* as in conventional support members. Device costs can be reduced as a result, while enabling stable regulation of a toner layer thickness, stable application of charge, as well as good image formation in a stable manner.

In the support configuration of the developing roller 210*d* of the present embodiment, the developing roller 210*d* is supported at a position overlapping the contact region between the developing roller 210*d* and the photoconductive drum 207, at an end of the developing roller 210*d* in the axial direction. Although a flange or a shaft portion for a bearing had to be provided, for instance in conventional cases, now the developing roller 210*d* can be supported as a result without resorting to such a configuration. The size of the developing frame 210*b* in the axial direction, i.e. the size of the device as a whole in the axial direction, can be reduced as a result.

A frame in the present embodiment includes both a developing frame and a non-driven-side bearing member. In the present embodiment, the developing frame and the bearing member have been explained as separate members, but the invention is not limited thereto, and the foregoing may be assembled into one frame. By virtue of the features, the present embodiment allows providing for instance a developing cartridge that supports a developing roller by resorting to a simple configuration, while securing attachment position precision.

Embodiment 2

A developing cartridge, a process cartridge and an image forming apparatus according to Embodiment 2 of the present invention will be explained next with reference to FIGS. 7A and 7B. Embodiment 2 differs from Embodiment 1 as regards the configuration of the developing roller support section of the non-driven-side bearing member. Only features different from those of Embodiment 1 above will be explained herein. Features that are not explained are identical to those of Embodiment 1.

Figure 7A:
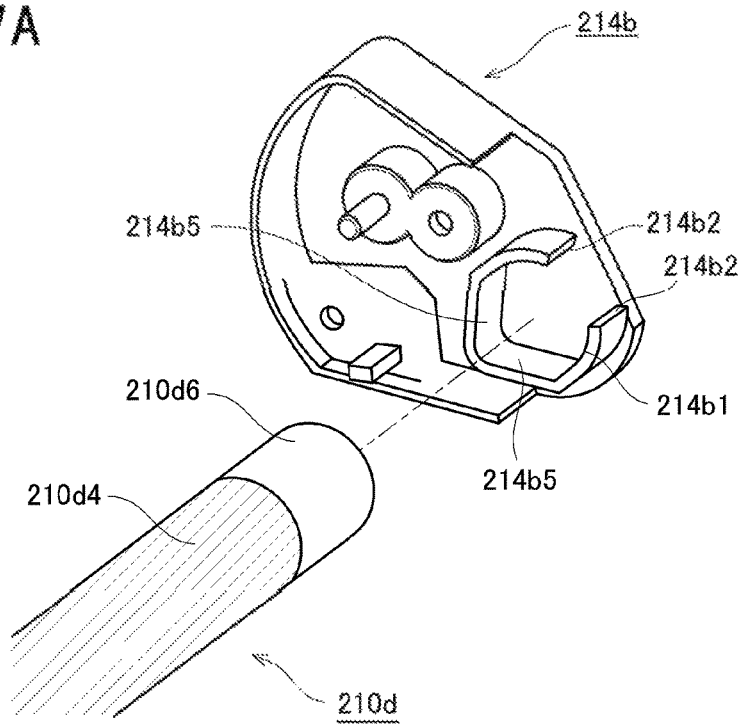
FIGS. 7A and 7B are schematic diagrams illustrating the configuration of a developing cartridge according to Embodiment 2 of the present invention.
Figure 7B:
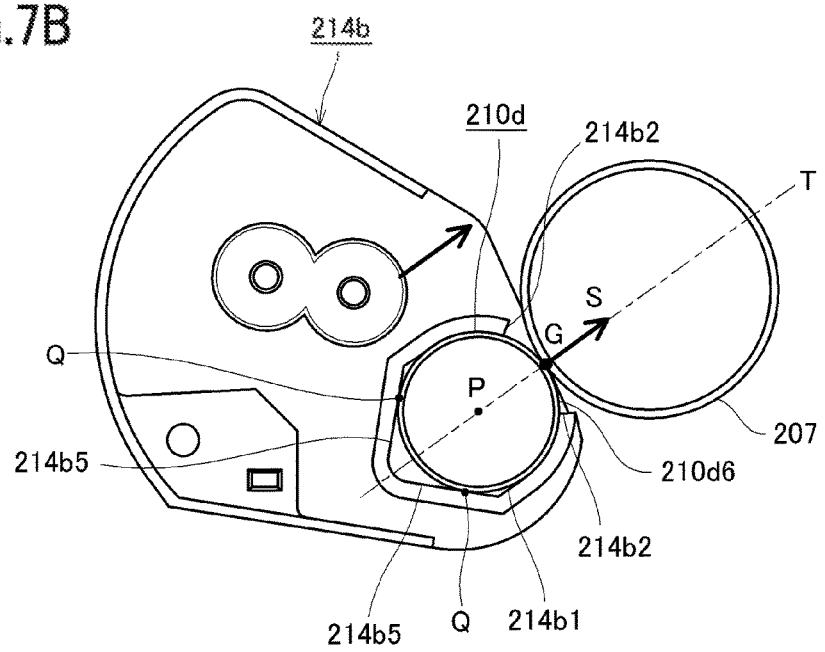

FIGS. 7A and 7B are schematic diagrams for explaining a support configuration on the non-driven side of the developing roller according to Embodiment 2 of the present invention. FIG. 7A is a perspective-view diagram illustrating, in an exploded view, a non-driven-side bearing member 214*b* and the non-driven-side end of the developing roller 210*d*. FIG. 7B is a schematic configuration diagram, of the interior of the developing cartridge, with the configuration of the non-driven side of the developing cartridge viewed along the axial direction of the developing roller. In FIG. 7B structures other than the non-driven-side bearing member 214*b*, the developing roller 210*d* and the photoconductive drum 207 have been omitted. As illustrated in FIGS. 7A and 7B, the non-driven-side bearing member 214*b* of the present embodiment has inclined surface sections 214*b*5 that are planarly formed at part of a developing roller support section 214*b*1. The inclined surface sections 214*b*5 are disposed so as to be in contact with the open section outer peripheral face 210*d*6, at two points Q that are separated from an imaginary line T that runs through the center P of the developing roller 210*d* and the center of the photoconductive drum 207, and that are further removed from the photoconductive drum 207 than the center P of the developing roller 210*d*. As a result, when the force S acts in the direction of the line T, the open section outer peripheral face 210*d*6 becomes reliably positioned at a total of three points, namely the two points Q of the inclined surface sections 214*b*5, and a contact point G between the developing roller 210*d* and the photoconductive drum 207.

Specifically, the flat inclined surface sections 214*b*5 are in contact with and supported on the peripheral face, i.e. the curved face, of the open section outer peripheral face 210*d*6, at part of the contact section between the developing roller 210*d* and the developing roller support section 214*b*1. Arcuate surfaces (concave surfaces) corresponding to respective parts of the peripheral face of the open section outer peripheral face 210*d*6 are formed in the vicinity of escape ends 214*b*2 of the developing roller support section 214*b*1. Therefore, a region in part of the developing roller support section 214*b*1 is configured so that the curved surfaces are in contact with the developing roller 210*d*, and support the latter, as in Embodiment 1.

In Embodiment 1, the support surface of the developing roller support section 214*a*1 is an arcuate surface corresponding to the peripheral face of the open section outer peripheral face 210*d*6, and, accordingly, a small clearance must be provided between the developing roller support section 214*a*1 and the open section outer peripheral face 210*d*6, from the viewpoint of, for instance, assemblability and dimensional tolerance. In the case of the configuration of Embodiment 1, therefore, it is not easy to define completely the contact point with the open section outer peripheral face 210*d*6 at the developing roller support section 214*a*1, and there arises a concern of fluctuation of the position of the developing roller 210*d* with respect to the developing roller support section 210*a*1, due for instance to vibration accompanying image formation.

In the present embodiment, by contrast, the positions of the open section outer peripheral face 210*d*6 and the non-driven-side bearing member 210*b* can be defined more reliably thanks to the above-described support configuration based on point-contact. As a result, the open section outer peripheral face 210*d*6 can be supported with good precision on the developing roller support section 214*b*1, even during image formation. It becomes therefore possible to position the developer transport section 210*d*4 with respect to the developing blade 210*e* with yet greater precision, and to obtain good images stably.

Embodiment 3

A developing cartridge, a process cartridge and an image forming apparatus according to Embodiment 3 of the present invention will be explained next with reference to FIG. 8 to FIG. 11. A lubricant such as grease is ordinarily interposed between the developing roller support section and the open section outer peripheral face in order to prevent adverse effects such as scraping of the developing roller support section due to sliding of the rotating developing roller. Embodiment 3 is configured so as to allow a lubricant to be effectively maintained interposed between the non-driven-side bearing member and the open section outer peripheral face of the developing roller. Only features different from those of the above embodiments will be explained herein. Features that are not explained are identical to those of the above embodiments.

Figure 8:
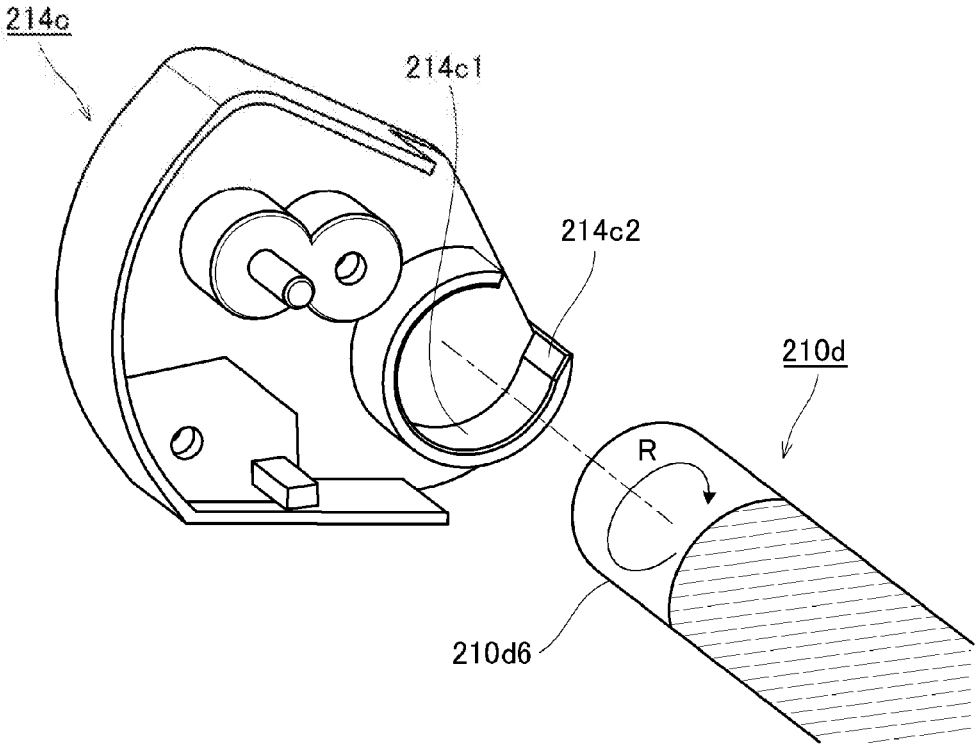
FIG. 8 is a perspective-view diagram of part of the configuration of a developing cartridge according to Embodiment 3 of the present invention.
Figure 9A:
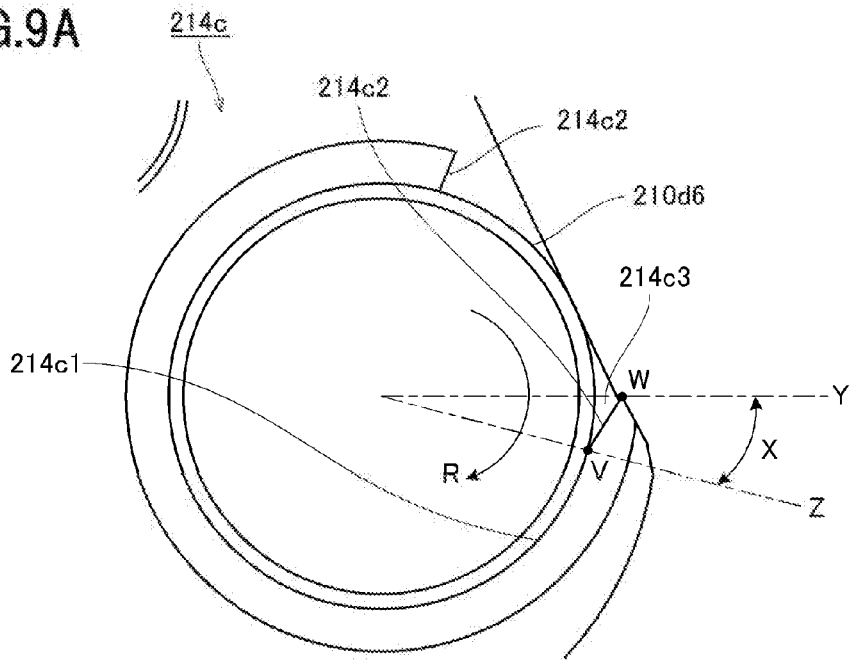
FIGS. 9A and 9B are schematic diagrams illustrating the configuration of the developing cartridge according to Embodiment 3 of the present invention.
Figure 9B:
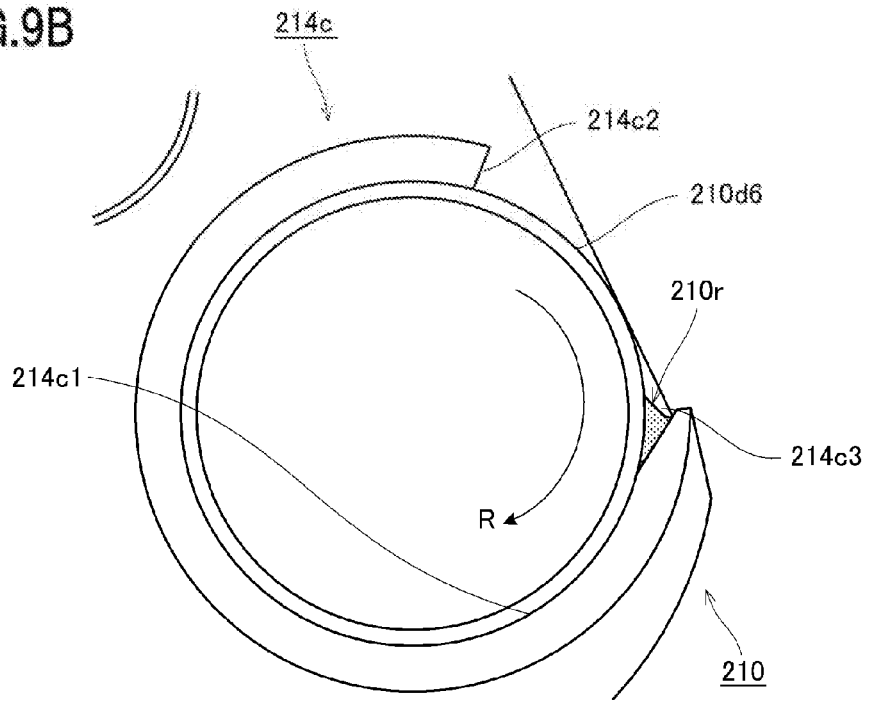

FIG. 8 is a perspective-view diagram illustrating, in an exploded view, the configuration of the non-driven side of the developing roller in Embodiment 3 of the present invention. FIGS. 9A and 9B are schematic configuration diagrams of the vicinity of a lubricant introduction section inside the developing cartridge, with the configuration of the non-driven side of the developing roller of Embodiment 3 of the present invention viewed in the axial direction of the developing roller. FIG. 9A is a diagram illustrating the positional relationship of this configuration, and FIG. 9B is a diagram illustrating a state of the lubricant in this configuration. In the present embodiment, an escape end 214*c*2 that is positioned upstream of the developing roller 210*d* in a rotation direction R is configured to have a shape that promotes introduction of a lubricant 210*r* between the escape end 214*c*2 and the open section outer peripheral face 210*d*6 of the developing roller 210*d*, at a developing roller support section 214*c*1.

In FIG. 9A, W denotes a point at which the escape end 214*c*2 is positioned furthest upstream in the rotation direction R, and V denotes a contact point (end of the support surface of the developing roller support section 214*c*1, upstream in the rotation direction R), between the open section outer peripheral face 210*d*6 and the escape end 214*c*2. Further, Y denotes an imaginary line that runs through the point W, from the center of the developing roller 210*d*, and Z denotes an imaginary line that runs through the contact point V, from the center of the developing roller 210*d*. As illustrated in FIG. 9A, the imaginary line Y forms an angle X with respect to the imaginary line Z, with the point W of the escape end 214*c*2 being positioned further upstream, in the rotation direction R, than the contact point V. A flat surface is configured between the point W and the contact point V. The escape end 214*c*2 at this flat section is configured to a shape such that the distance between the escape end 214*c*2 and the open section outer peripheral face 210*d*6 narrows gradually in the rotation direction R. As a result there is formed a lubricant introduction section 214*c*3 becomes formed being a wedge-like space surrounded by the imaginary line Y, the flat section of the escape end 214*c*2 and the open section outer peripheral face 210*d*6.

Due to the rotation of the developing roller 210*d*, part of the lubricant 210*r* that is interposed between the developing roller support section 214*c*1 and the open section outer peripheral face 210*d*6 leaves the escape end 214*c*2 on the downstream side of the rotation direction R, and moves to a region of the developing roller 210*d* not in contact with the developing roller support section 214*c*1. On account of further rotation of the developing roller 210*d*, the lubricant 210*r* that has moved to the non-contact region moves then once more from the lubricant introduction section 214*c*3 formed on the escape end 214*c*2 on the upstream side in the rotation direction R, to the region of contact with the developing roller support section 214*c*1. As described above, the lubricant introduction section 214*c*3 has a shape such that the distance thereof to the open section outer peripheral face 210*d*6 narrows gradually in the direction of movement of the lubricant 210*r* derived from rotation of the developing roller 210*d*. The lubricant 210*r* is thus held in the lubricant introduction section 214*c*3, and is smoothly introduced into the contact region with the developing roller support section 214*c*1. As a result, it becomes possible to suppress, for instance, exposure or leakage of the lubricant 210*r* outside the developing cartridge 210, and to prevent unintended migration of the lubricant 210*r* to other components, such as the photoconductive drum 207.

Figure 10:
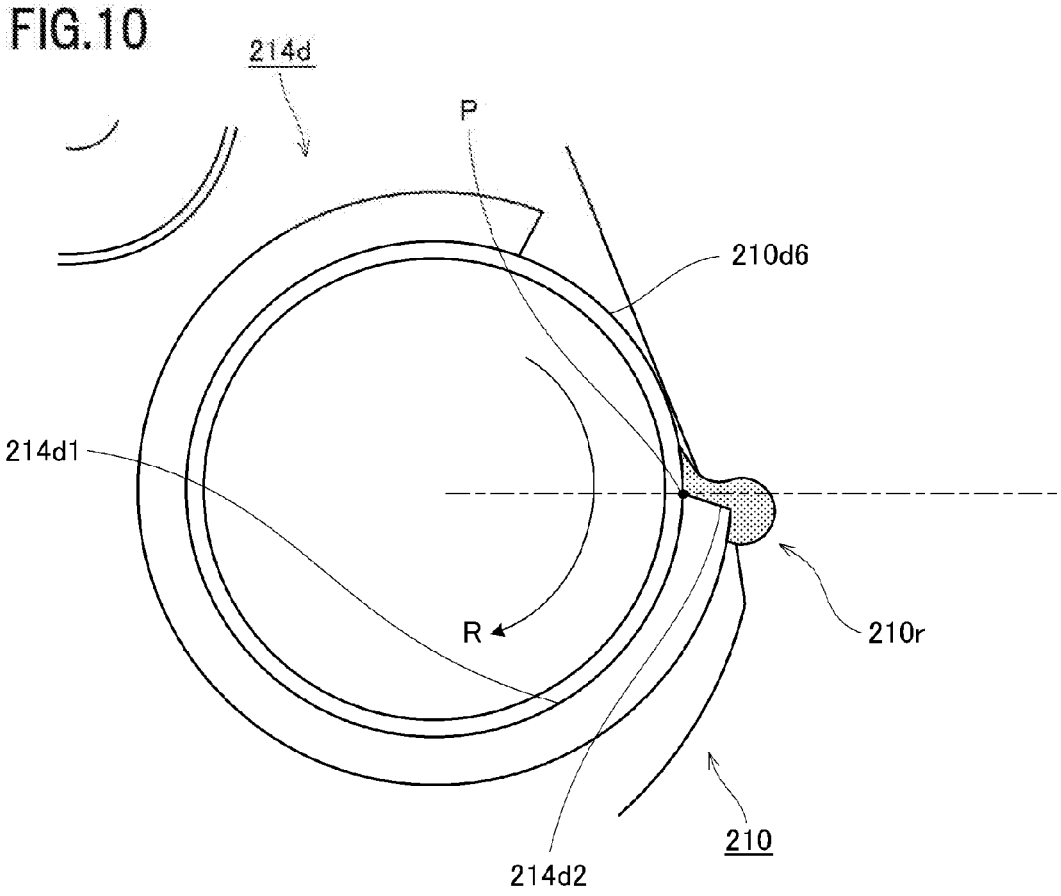
FIG. 10 is a schematic diagram illustrating the configuration of a developing cartridge according to Comparative example 1.

FIG. 10 is a schematic configuration diagram, of the interior of the developing cartridge, with the configuration of the non-driven side of the developing roller in Comparative example 1 viewed along the axial direction of the developing roller. FIG. 10 illustrates a state of the lubricant in this configuration. The configuration of Comparative example 1 illustrated in FIG. 10 does not have a lubricant introduction section 214*c*3 such as the one of the present embodiment. As illustrated in FIG. 10, specifically, an escape end 214*d*2 of the present comparative example is configured such that the point W of the escape end 214*d*2 furthest upstream in the rotation direction R, and the contact point V between the open section outer peripheral face 210*d*6 and the escape end 214*d*2, coincide at a same point P. In the present comparative example, as a result, there is formed no lubricant introduction section 214*c*3 such as that of the present embodiment. In this case, the lubricant 210*r* is scraped off at the point P, accompanying the rotation of the developing roller 210*d*, and may become exposed outside the developing cartridge 210. As a result, the scraped off lubricant 210*r* may migrate to other components, such as the photoconductive drum 207, and contaminate the recording medium 2 or the interior of the image forming apparatus 200.

Figure 11:
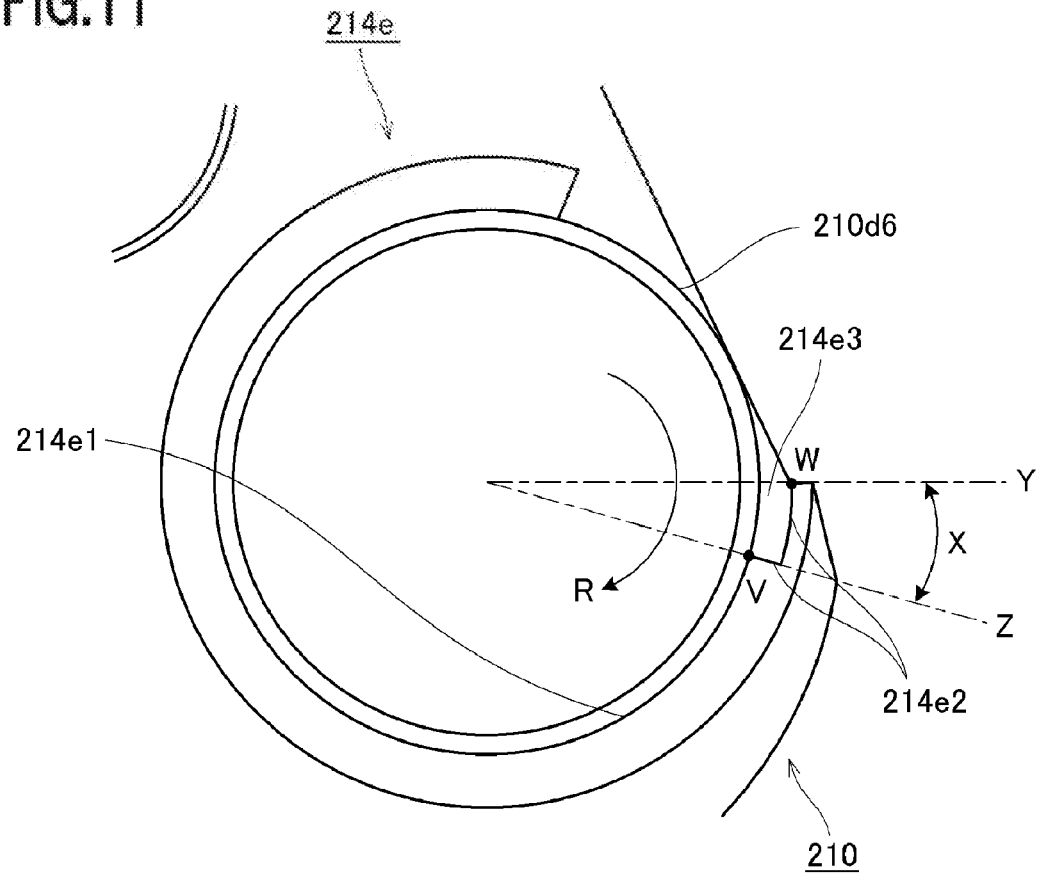
FIG. 11 is a schematic diagram illustrating the configuration of a developing cartridge according to a variation of Embodiment 3 of the present invention.

FIG. 11 is a schematic configuration diagram, of the interior of the developing cartridge, with the configuration of the non-driven side of the developing roller in a variation of the present embodiment viewed along the axial direction of the developing roller. The variation illustrated in FIG. 11 is another configuration that allows achieving an effect similar to that of the present embodiment. In the present embodiment, the lubricant introduction section 214*c*3 is formed by one flat surface that joins the point W and the contact point V, but a lubricant introduction section 214*e*3 may be formed through joining of the point W and the contact point V by two surfaces as in the variation illustrated in FIG. 11. In the present variation, the lubricant introduction section 214*e*3 is formed by two surfaces, namely an arcuate surface that extends along the open section outer peripheral face 210*d*6, from the point W, and a flat surface that extends along the imaginary line Z. As a result there is formed the lubricant introduction section 214*e*3, which is a space defined by the imaginary line Y, the above two surfaces, and the open section outer peripheral face 210*d*6. In such an escape end 214*e*2 as well having two surfaces, the lubricant 210*r* can be stored in the lubricant introduction section 214*e*3, and can be prevented from leaking out onto the surface of the developing cartridge 210, as in the case of the escape ends 214*c*2 of the present embodiment.

Embodiment 4

A developing cartridge, a process cartridge and an image forming apparatus according to Embodiment 4 of the present invention will be explained next with reference to FIG. 12 to FIGS. 14A and 14B. The image forming apparatus according to the present embodiment is configured by relying on contact developing as a developing scheme. Only features different from those of the above embodiments will be explained herein. Features that are not explained are identical to those of the above embodiments.

Figure 12:
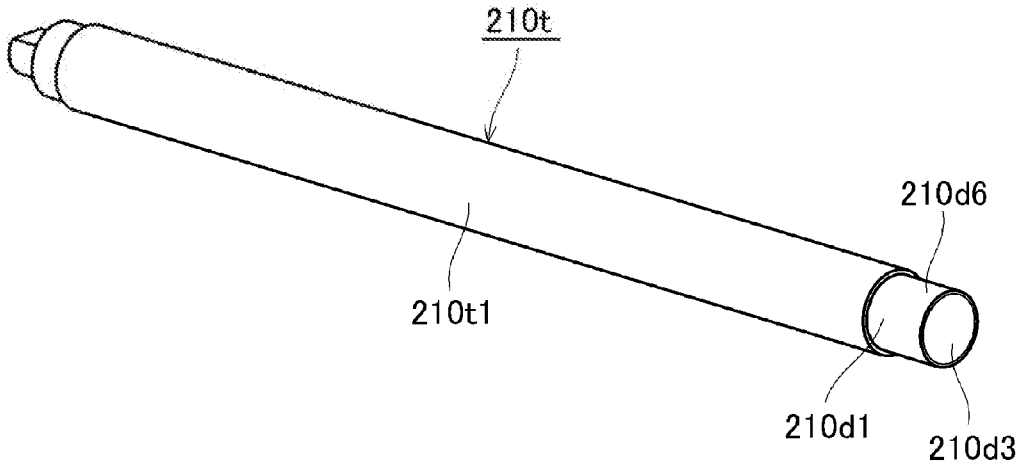
FIG. 12 is a perspective-view diagram of a developing roller according to Embodiment 4 of the present invention.

FIG. 12 is a perspective-view diagram of a developing roller 210*t* according to the present embodiment. In the configuration of contact developing, a stable contact width (width in the rotation direction of the developing roller 210*t* or the photoconductive drum 207) must be secured, at a contact region (nip section) of the developing roller 210*t* and the photoconductive drum 207, in order to obtain stable good images. Accordingly, the developing roller 210*t* that is used has an elastic coat layer 210*t*1, made up of rubber or the like, on the outer peripheral face of the developing roller body 210*d*1, as illustrated in FIG. 12. The thickness of the coat layer 210*t*1 in the present embodiment is set to 1.0 mm.

Figure 13:
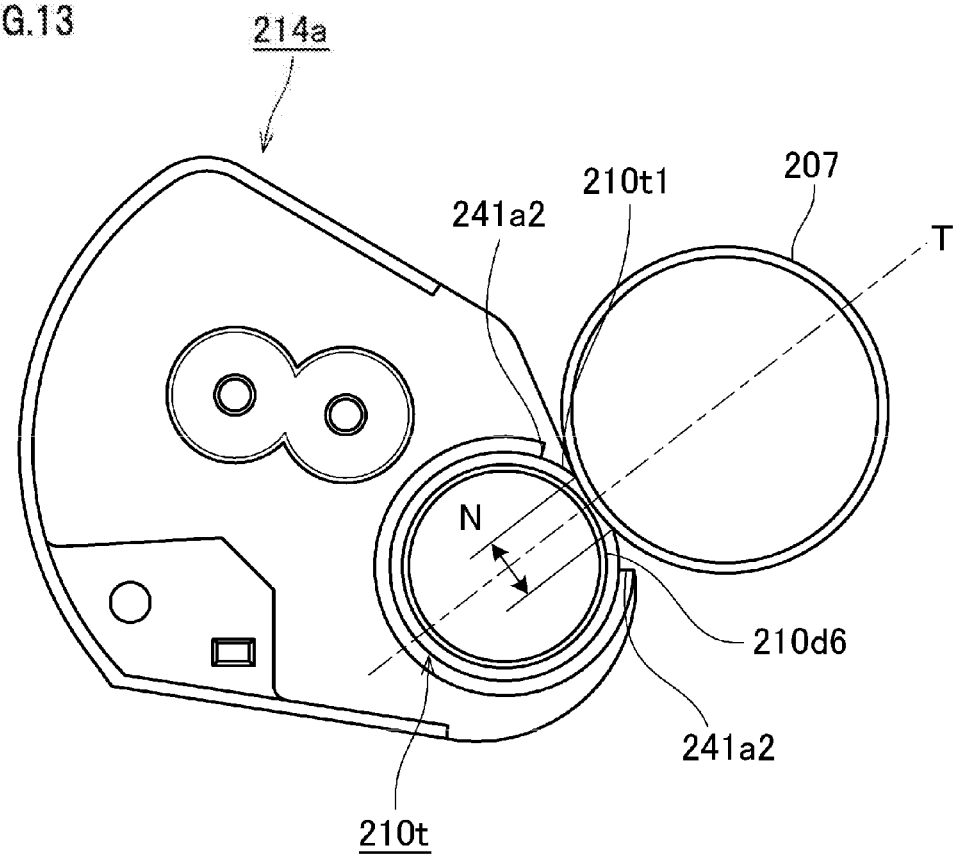
FIG. 13 is a schematic diagram illustrating the configuration of the developing cartridge according to Embodiment 4 of the present invention.

FIG. 13 is a schematic diagram illustrating a schematic configuration, of the interior of the developing cartridge, with the configuration of the present embodiment non-driven side of the developing cartridge according to the present embodiment viewed along the axial direction of the developing roller 210*t*. FIG. 13 illustrates the positional relationship with respect to the photoconductive drum 207, on the non-driven side of the developing roller 210*t*. In FIG. 13 structures other than the non-driven-side bearing member 214*a*, the developing roller 210*t* and the photoconductive drum 207 have been omitted.

The photoconductive drum 207 and the developing roller 210*t* are disposed in such a manner that the outer peripheral faces thereof are in mutual pressure-contact in a direction perpendicular to the axes of the photoconductive drum 207 and the developing roller 210*t*. An urging force S mutually acts, in the cross-section perpendicular to the axes, in the direction of an imaginary line T that runs through the centers of rotation, as illustrated in FIG. 13. By virtue of this force S, the photoconductive drum 207 squashes the coat layer 210*t*1 of the developing roller 210*t*, as a result of which a nip section having a predetermined contact width N in the rotation direction of the developing roller 210*t* or the photoconductive drum 207 becomes formed between the photoconductive drum 207 and the developing roller 210*t*. The squashing amount of the coat layer 210*t*1 is determined mainly by the magnitude of the force S and the hardness of the coat layer 210*t*1. The contact width N in turn is determined by the squashing amount.

In the present embodiment, the escape ends 214*a*2 are provided in the developing roller support section 214*a*1 of the non-driven-side bearing member 214*a*, as in Embodiment 1. In a case, for instance, of a configuration such that the entire circumference of the open section outer peripheral face 210*d*6 are supported, without the escape ends 214*a*2 being provided in the developing roller support section 214*a*1, the thickness of the coat layer 210*t*1 must be set taking into consideration the interference between the developing roller support section 214*a*1 and the photoconductive drum 207. Specifically, the thickness of the coat layer 210*t*1 must be set taking into consideration the extent of squashing of the coat layer 210*t*1, in such a manner that the developing roller support section 214*a*1 and the photoconductive drum 207 do not interfere on account of the squashing of the coat layer 210*t*1. Thanks to the configuration of the present embodiment having the escape ends 214*a*2, by contrast, the developing roller 210*d* that does not interfere with the photoconductive drum 207 can be supported without being affected by the extent of squashing, i.e. by the thickness, of the coat layer 210*t*1. Specifically, the thickness of the coat layer 210*t*1 can be made as small as possible, within a range such that the contact width N can be secured.

Figure 14A:
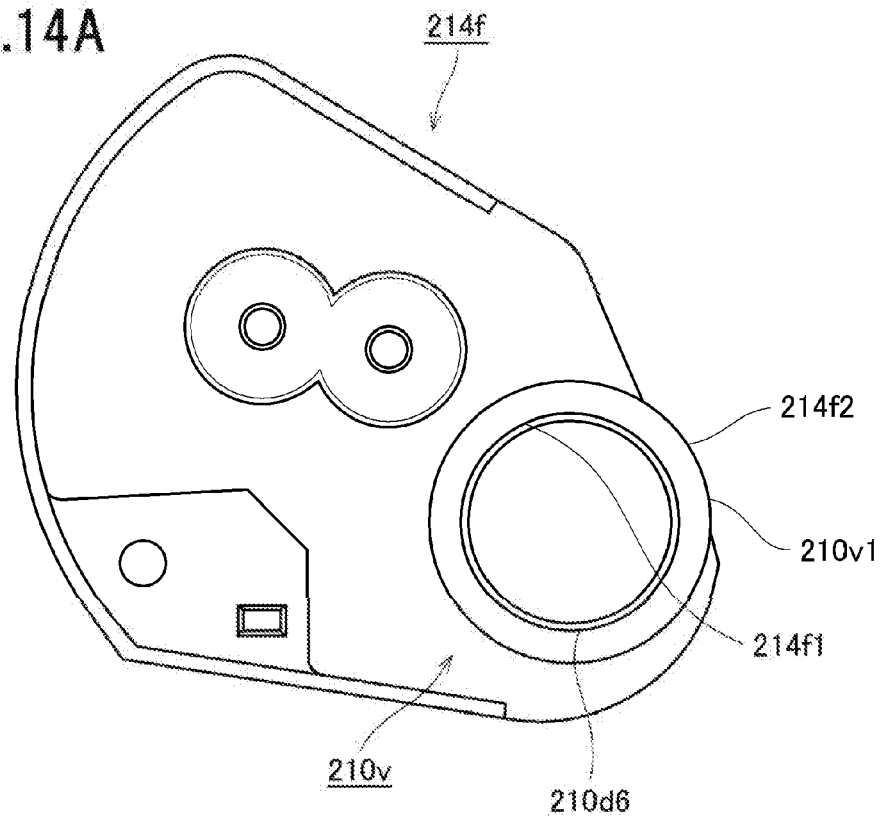
FIGS. 14A and 14B are schematic diagrams illustrating the configuration of a developing cartridge according to Comparative example 2.
Figure 14B:
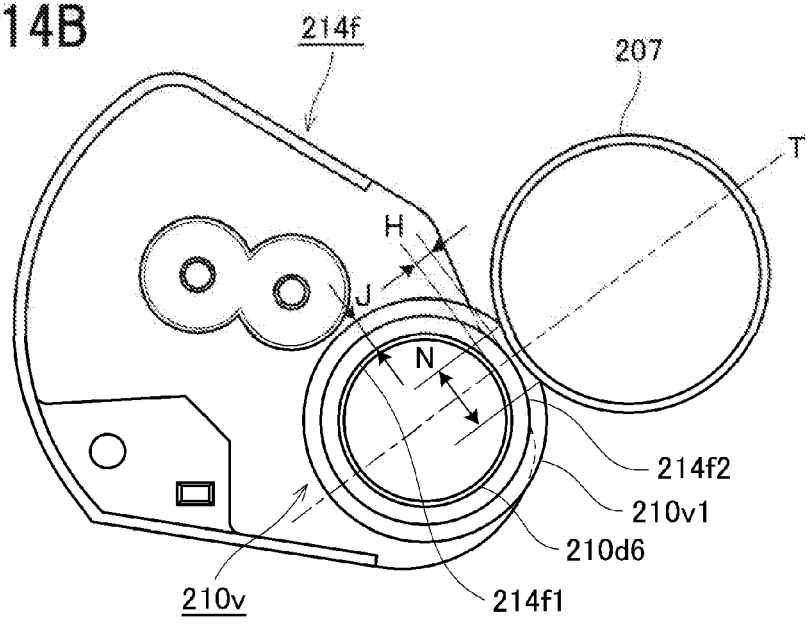

FIG. 14A and FIG. 14B are schematic configuration diagrams, of the interior of the developing cartridge, with the configuration of the non-driven side of the developing cartridge viewed along the axial direction of a developing roller 210*v*, in the case of a configuration (Comparative example 2) in which the escape ends 214*a*2 described above are not provided. FIG. 14A illustrates only a non-driven-side bearing member 214*f* and the open section outer peripheral face 210*d*6 in this configuration. The figure illustrates a state at a time where a coat layer 210*v*1 of the developing roller 210*v* is not squashed by the photoconductive drum 207. FIG. 14B is a diagram illustrating also the photoconductive drum 207, in addition to the depiction of FIG. 14A. FIG. 14B illustrates a state at a time where the coat layer 210*v*1 of the developing roller 210*v* is squashed by the photoconductive drum 207.

As illustrated in FIG. 14A, the non-driven-side bearing member 214*f* in the present configuration has a cylindrical developing roller support section 214*f*1 that supports the entire circumference of the open section outer peripheral face 210*d*6 of the developing roller 210*d*. The developing roller 210*v* used in the present configuration has the coat layer 210*v*1 that is thicker than the coat layer 210*t*1 of the developing roller 210*t* described above.

As illustrated in FIG. 14B, the reference symbol H denotes the distance between an outer peripheral face 214*f*2 and the inner peripheral face of the developing roller support section 214*f*1, on an imaginary line T that runs through the centers of rotation of the photoconductive drum 207 and the developing roller 210*t*, i.e. denotes the thickness of the developing roller support section 214*f*1. The reference symbol J denotes the thickness of the coat layer 210*v*1. The developing roller support section 214*f*1 interferes with the photoconductive drum 207, in the case of a configuration where the position of the developing roller support section 214*f*1 in the axial direction overlaps the photoconductive drum 207 when the thickness J is smaller than the distance H. This interference hinders contact between the photoconductive drum 207 and the coat layer 210*v*1, and renders contact developing impossible. Therefore, in the case of a configuration where the non-driven-side bearing member 214*f* is used that is provided with the cylindrical developing roller support section 214*f*1, the thickness J must be at least larger than the distance H, in order to elicit contact between the coat layer 210*d* and the photoconductive drum 207. Meanwhile, the distance H, i.e. the thickness of the developing roller support section 214*f*1, must be large enough so that strength can be secured. In consequence, the thickness J of the coat layer 210*v*1 of the developing roller 210*v* is large, and the use amount of the material (for instance, rubber material) of the coat layer 210*v*1 increases. Costs increase accordingly due to the greater amount of material used.

The features of the present embodiment as explained above can be summarized as follows. In the present embodiment, the escape ends 214*a*2 are provided in the developing roller support section 214*a*1, as in Embodiment 1, in an image forming apparatus of contact developing scheme in which the photoconductive drum 207 and the developing roller 210*t* are brought into contact in such a manner that the contact width N is secured. The present embodiment allows reducing the thickness of the coat layer 210*t*1 of the developing roller 210*t* within a range such that the contact width N is secured. It becomes therefore possible to reduce the use amount of the material (rubber material or the like) of the coat layer 210*t*1, and to cut costs accordingly.

Embodiment 5

A developing cartridge, a process cartridge and an image forming apparatus according to Embodiment 5 of the present invention will be explained next with reference to FIG. 15 to FIG. 17. Embodiment 5 involves a different configuration that allows obtaining the same effect as Embodiment 4 above. Only features different from those of the above embodiments will be explained herein. Features that are not explained are identical to those of the above embodiments.

Figure 15:
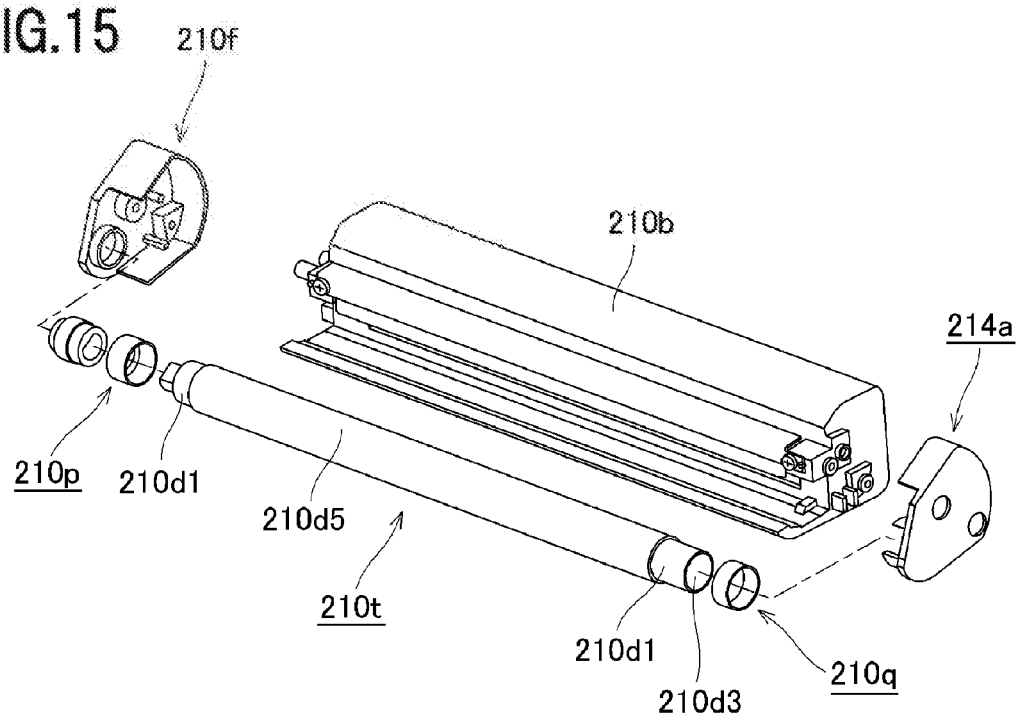
FIG. 15 is a perspective-view diagram of a developing cartridge according to Embodiment 5 of the present invention.

FIG. 15 is a perspective-view diagram illustrating, in an exploded view, the support configuration of the developing roller 210*t* in the developing cartridge of the present Embodiment 5. As illustrated in FIG. 15, a driven-side squashing amount regulating member 210*p* having a cap shape is attached to the driven side of the roller body 210*d*1, on the driven side of the developing roller 210*t*. Similarly, a non-driven-side squashing amount regulating member 210*q* having a ring shape (cylindrical shape) is attached to the non-driven side of the roller body 210*d*1, on the non-driven side of the developing roller 210*t*.

Figure 16:
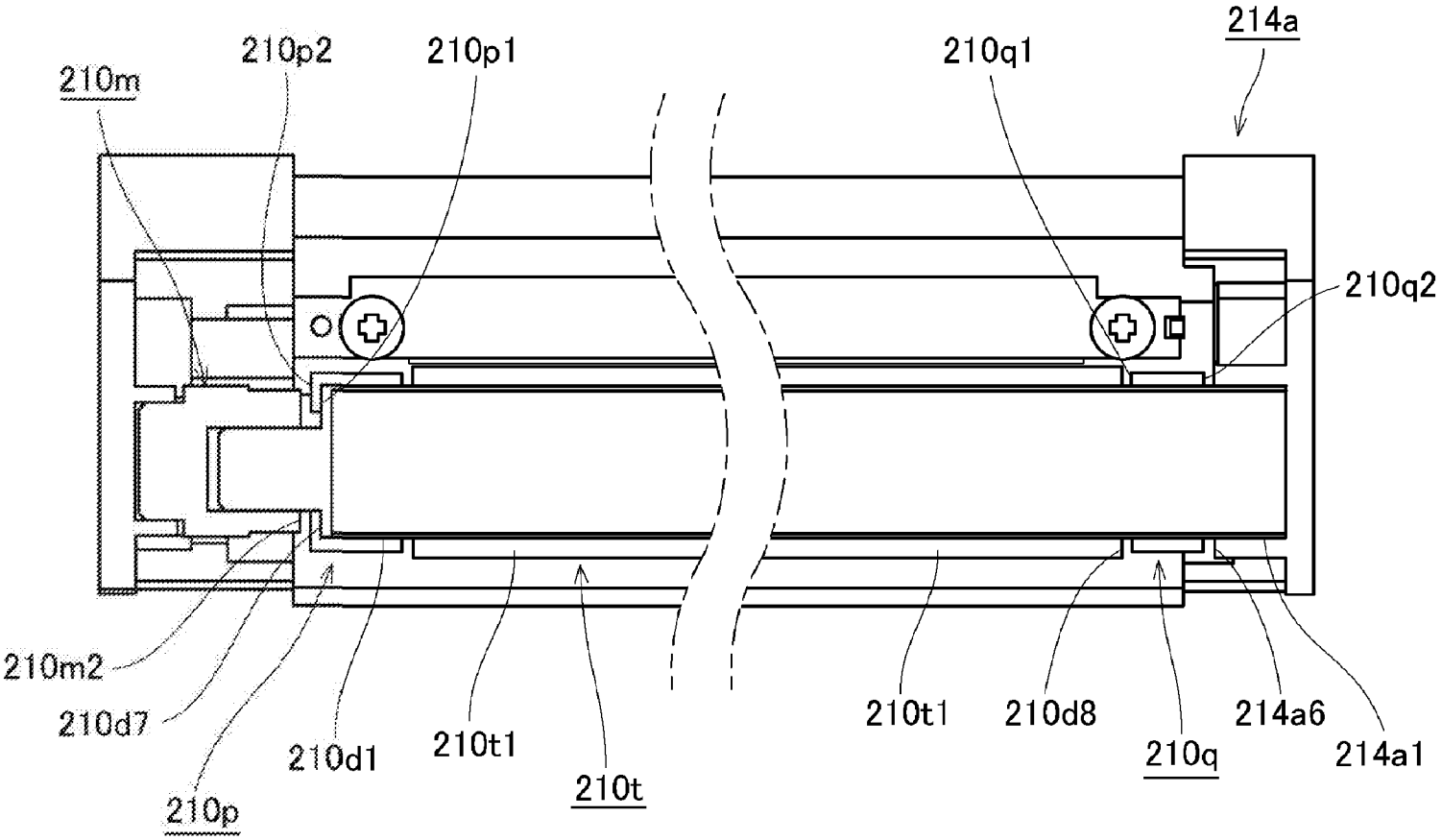
FIG. 16 is a schematic cross-sectional diagram of the developing cartridge according to Embodiment 5 of the present invention.

FIG. 16 is a schematic cross-sectional diagram for explaining the positioning of the driven-side squashing amount regulating member 210*p* and the non-driven-side squashing amount regulating member 210*q* in the axial direction of the developing roller 210*t*. As illustrated in FIG. 16, the driven-side squashing amount regulating member 210*p* has a developing roller contact section 210*p*1 at which the developing roller 210*t* becomes positioned, on the driven side of the axial direction, through abutting with the driven-side end face 210*d*7 of the roller body 210*d*1. The driven-side squashing amount regulating member 210*p* has a gear contact section 210*p*2 at which the developing roller 210*t* becomes positioned, on the non-driven side of the axial direction, through abutting with a gear end face 210*m*2 of the developing roller gear 210*m*. Meanwhile, the non-driven-side squashing amount regulating member 210*q* has a coat layer contact section 210*q*1 at which the developing roller 210*t* becomes positioned, on the non-driven side of the axial direction, through abutting with the non-driven-side end face 210*d*8 of the coat layer 210*t*1. The non-driven-side squashing amount regulating member 210*q* has a bearing contact section 210*q*2 at which the developing roller 210*t* becomes positioned, on the driven side of the axial direction, through abutting with a longitudinal regulating section 214*a*6 of the non-driven-side bearing member 214*a*.

Figure 17:
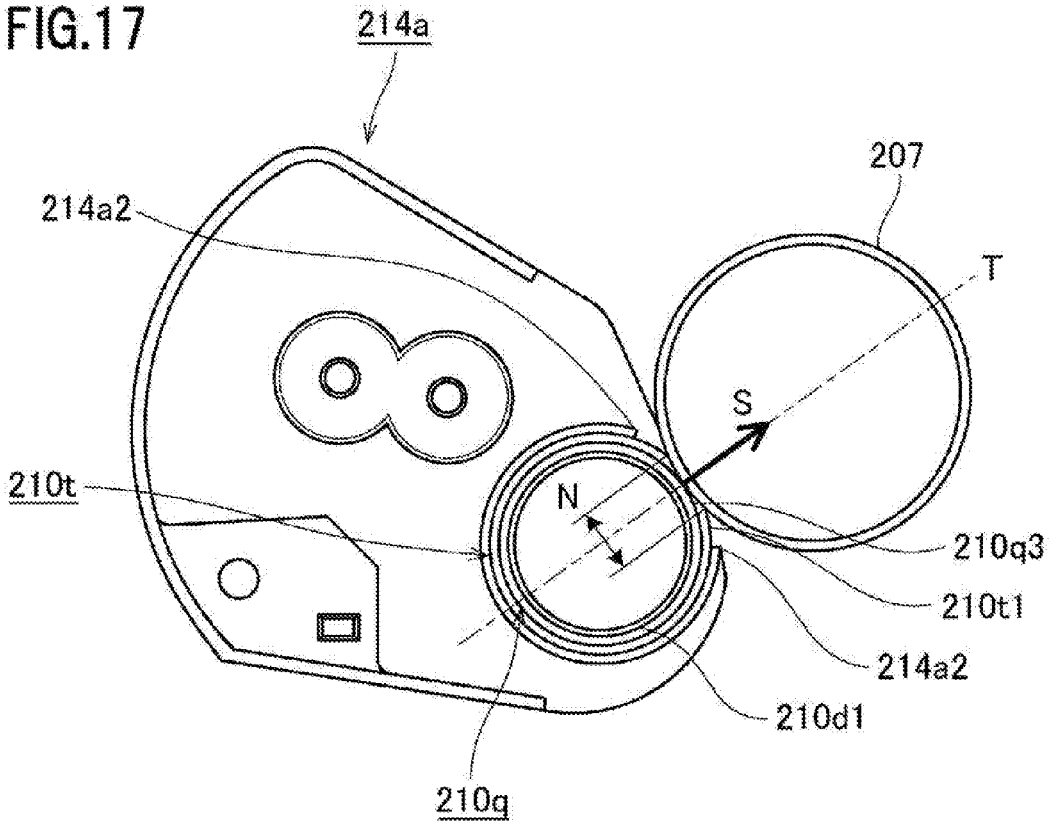
FIG. 17 is a schematic diagram illustrating the configuration of the developing cartridge according to Embodiment 5 of the present invention.

FIG. 17 is a schematic diagram illustrating a schematic configuration, on the interior of the developing cartridge, with the non-driven side of the developing cartridge according to the present embodiment viewed along the axial direction of the developing roller 210*t*. FIG. 17 illustrates the positional relationship between the photoconductive drum 207 and the non-driving squashing amount regulating member 210*q*, on the non-driven side. In FIG. 17 structures other than the non-driven-side bearing member 214*a*, the developing roller 210*t*, the photoconductive drum 207 and the non-driving squashing amount regulating member 210*q* have been omitted.

As illustrated in FIG. 17, the photoconductive drum 207 and the developing roller 210*t* are disposed in such a manner that the outer peripheral faces thereof are in mutual pressure-contact in a direction perpendicular to the axes. An urging force S mutually acts, in the cross-section perpendicular to the axes, in the direction of an imaginary line T that runs through the centers of rotation. At this time, the photoconductive drum 207 abuts a photoconductive drum contact section 210*q*3 of the non-driven-side squashing amount regulating member 210*q*. This abutting determines the squashing amount of the coat layer 210*t*1 by the photoconductive drum 207, and the contact width N is in turn determined by the squashing amount.

Through setting of the arrangement of the photoconductive drum 207 and the developing roller 210*t* in such a manner that the force S is of certain magnitude, it becomes possible to maintain a contact state between the photoconductive drum 207 and the photoconductive drum contact section 210*q*3, even when the force S fluctuates due to, for instance, vibration during image formation. Accordingly, a stable squashing amount of the coat layer 210*t*1 can be maintained also during image formation, and thus a stable contact width N can be likewise maintained during image formation. The driven-side squashing amount regulating member 210*p* as well regulates, to a certain amount, the squashing amount of the coat layer 210*t*1 of the developing roller 210*t* by the photoconductive drum 207, in accordance with a method similar to that of the non-driven-side squashing amount regulating member 210*q*. As a result, a stable contact width N can be maintained during image formation, on the driven side as well.

The present embodiment allows thus suppressing fluctuations of the contact width N of the coat layer 210*t*1 and the photoconductive drum 207 during image formation, upon contact of the developing roller 210*t* and the photoconductive drum 207, and allows providing a configuration whereby good images are obtained more stably.

Embodiment 6

A developing cartridge, a process cartridge and an image forming apparatus according to Embodiment 6 of the present invention will be explained next with reference to FIG. 18 and FIG. 19. The characterizing feature of Embodiment 6 is the power supply configuration of developing bias to the developing roller 210*t*. Only features different from those of the above embodiments will be explained herein. Features that are not explained are identical to those of the above embodiments.

Figure 18:
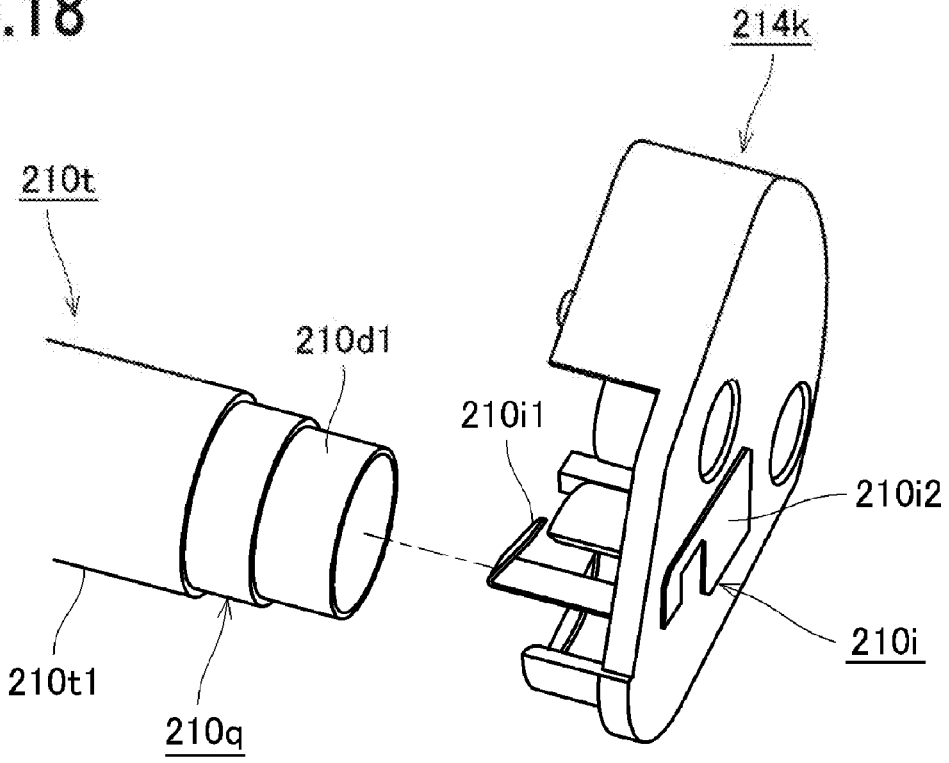
FIG. 18 is a perspective-view diagram illustrating part of the configuration of a developing cartridge according to Embodiment 6 of the present invention.
Figure 19:
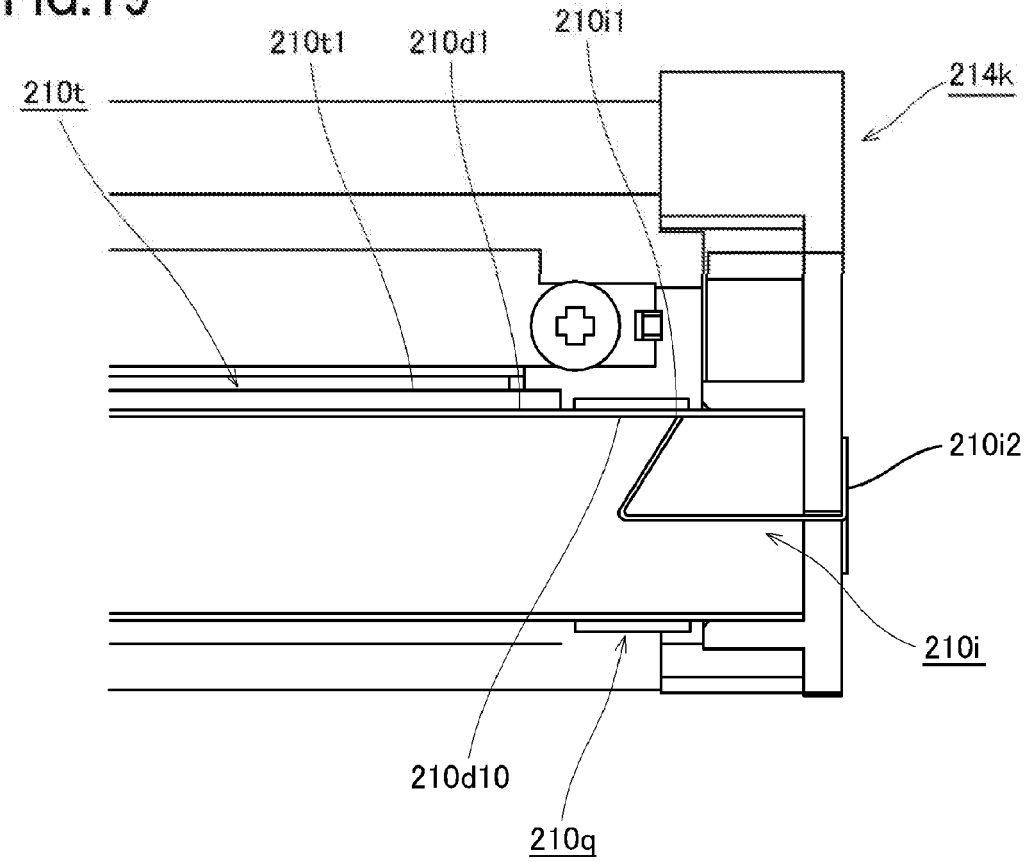
FIG. 19 is a schematic cross-sectional diagram of the developing cartridge according to Embodiment 6 of the present invention.

FIG. 18 is a perspective-view diagram illustrating, in an exploded view, a non-driven-side bearing member 214*k* and the non-driven-side end of the developing roller 210*t* in the present embodiment. FIG. 19 is a schematic cross-sectional diagram illustrating the configuration of the non-driven side of the developing cartridge in the present embodiment. The developing cartridge in the present embodiment is provided with a power supply member (conductive member) 210*i* that is formed through bending of a flat plate of a metal having high conductivity, and is configured out of a single component, as a member that transmits developing bias to the developing roller 210*t*. The power supply member 210*i* is attached to the non-driven-side bearing member 214*k*. As illustrated in FIG. 19, the power supply member 210*i* has a developing roller contact section 210*i*1 that is in contact with a roller body inner peripheral face 210*d*10 that constitutes the inner peripheral face of the roller body 210*d*1. The developing roller contact section 210*i*1 is in pressure-contact with the roller body inner peripheral face 210*d*10, on account of an elastic force arising from metal deformation. The power supply member 210*i* has a body contact section 210*i*2, that is in pressure-contact with a developing bias power supply unit (not shown), provided in the apparatus body of the image forming apparatus, and to which a predetermined developing bias is supplied from the body side. In the above configuration, developing bias is supplied from the developing bias power supply unit, not shown, to the power supply member 210*i*, via the body contact section 210*i*2; the developing bias passes through the power supply member 210*i*, and is supplied to the developing roller 210*t* from the developing roller contact section 210*i*1.

Leakage between the developing roller 210*t* and the photoconductive drum 207, upon supply of developing bias, is a concern in the developing assembly. Ordinary methods for preventing leakage include, for instance, interposing a non-conductive substance between the developing roller 210*t* and the photoconductive drum 207, and/or separating the developing roller 210*t* and the photoconductive drum 207 by a distance ranging from about 0.2 mm to 1.0 mm. The configuration in the present embodiment includes the driven-side squashing amount regulating member 210*p* and the non-driven-side squashing amount regulating member 210*q* described above. Further, the thicknesses of the driven-side squashing amount regulating member 210*p* and the non-driven-side squashing amount regulating member 210*q* are set to a magnitude such that a predetermined distance (0.5 mm) can be secured that allows preventing leakage between the developing roller 210*t* and the photoconductive drum 207. Therefore, the power supply member 210*i* that is in contact with the roller body inner peripheral face 210*d*10 is necessarily disposed spaced apart from the photoconductive drum 207, by a distance (0.5 mm) that allows preventing leakage to the photoconductive drum 207.

By virtue of the present embodiment, a power supply configuration can be formed that allows supplying developing bias to the developing roller 210*t* via the power supply member 210*i*, while maintaining a predetermined leakage prevention distance with photoconductive drum 207. The developing roller contact section 210*i*1 is configured to be in pressure-contact with the roller body inner peripheral face 210*d*10. Therefore, energized contact is enabled while allowing for a certain degree of dimensional error, so that it becomes possible to lower the requested dimensional precision. A configuration can therefore be provided, at a low cost, that allows supplying developing bias to the developing roller 210*t* stably and without adverse effects.

Embodiment 7

A developing cartridge, a process cartridge and an image forming apparatus according to Embodiment 7 of the present invention will be explained next with reference to FIG. 20 to FIG. 22. The characterizing feature of Embodiment 7 is the power supply configuration of developing bias to the developing roller 210*t*. Only features different from those of the above embodiments will be explained herein. Features that are not explained are identical to those of the above embodiments.

Figure 20:
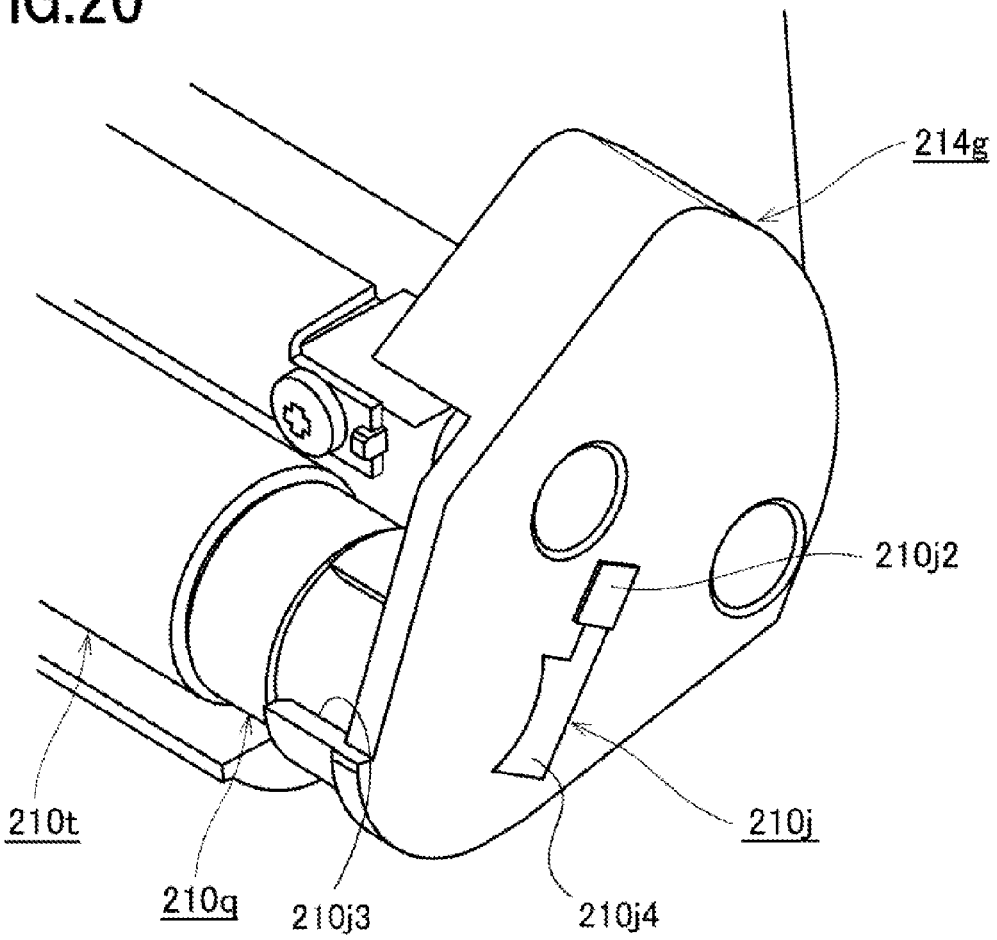
FIG. 20 is a perspective-view diagram illustrating part of the configuration of a developing cartridge according to Embodiment 7 of the present invention.

FIG. 20 is a perspective-view diagram illustrating the configuration of the non-driven-side end of the developing roller 210*t* according to the present embodiment. FIG. 21 is a perspective-view diagram illustrating, in an exploded view, a non-driven-side bearing member 214*g* and the non-driven-side end of the developing roller 210*t* in the present embodiment. FIG. 22 is a schematic diagram illustrating a schematic configuration, on the interior of the developing cartridge, with the non-driven side of the developing cartridge according to the present embodiment viewed along the axial direction of the developing roller 210*t*. In FIG. 22 structures other than the non-driven-side bearing member 214*g*, the open section outer peripheral face 210*d*6 of the developing roller 210*t*, the photoconductive drum 207 and the conductive section 210*j* have been omitted.

Figure 21:
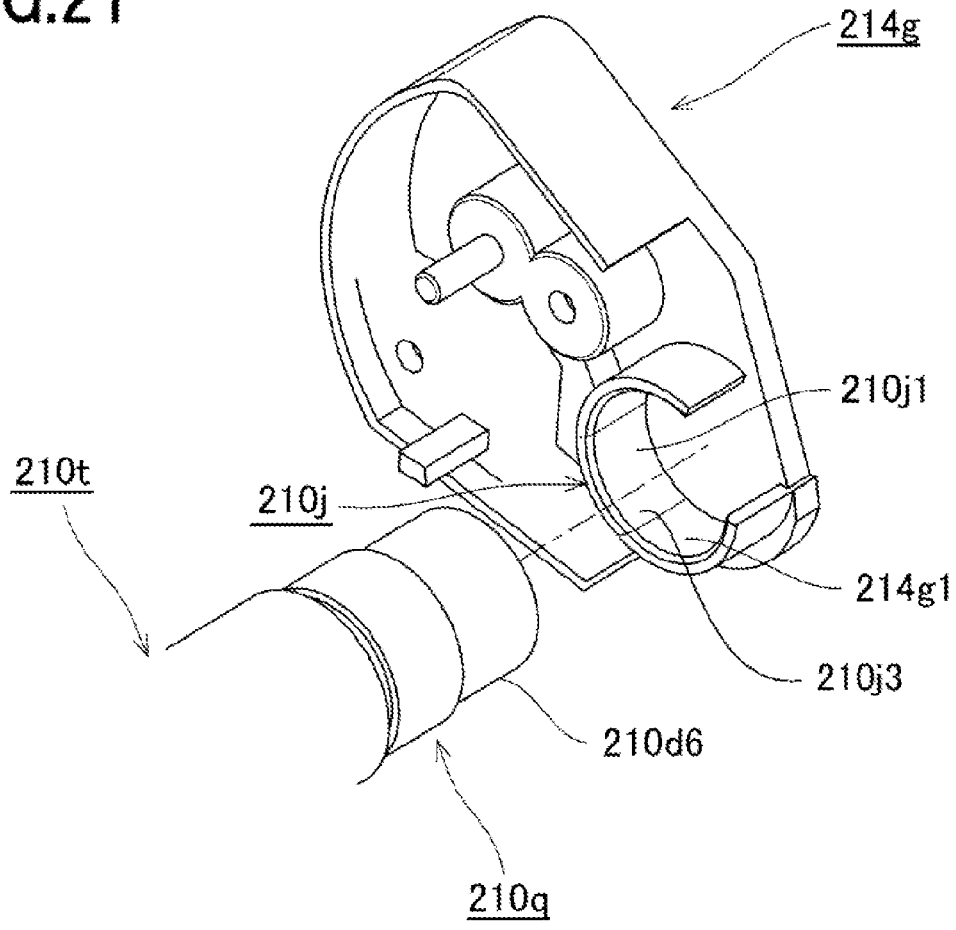
FIG. 21 is a perspective-view diagram illustrating part of the configuration of the developing cartridge according to Embodiment 7 of the present invention.
Figure 22:
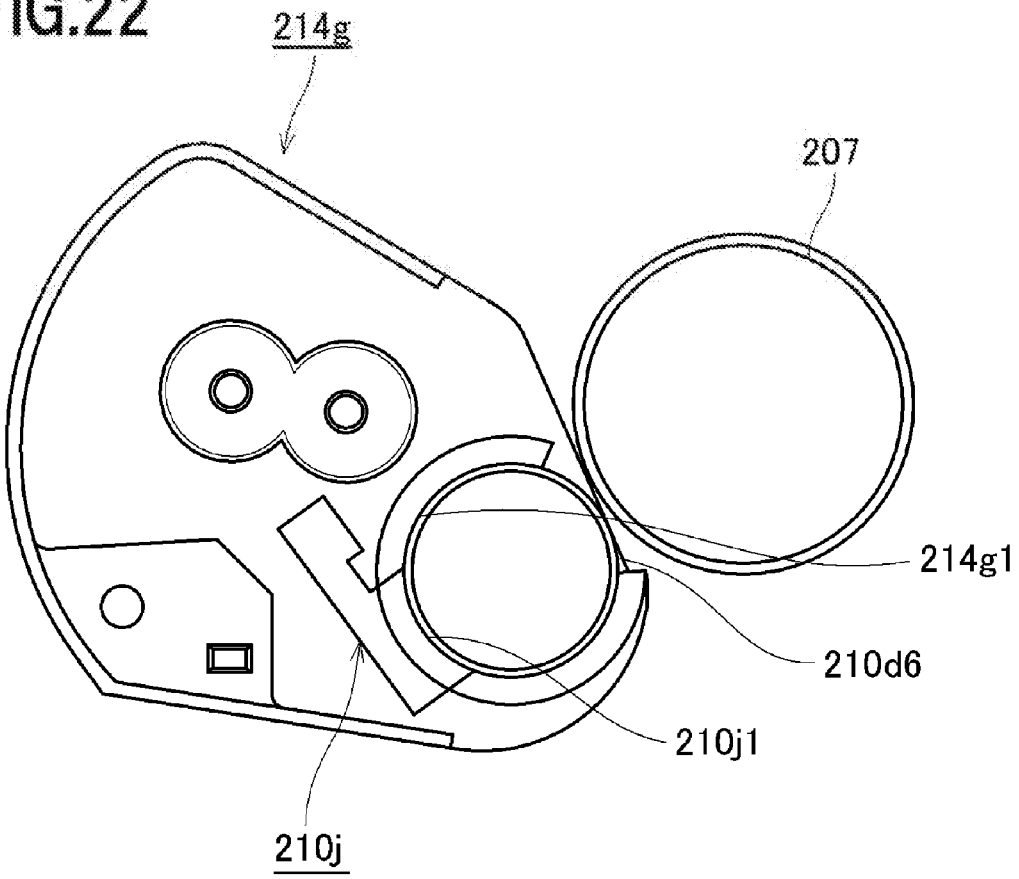
FIG. 22 is a schematic diagram illustrating the configuration of the developing cartridge according to Embodiment 7 of the present invention.

As illustrated in FIG. 20 and FIG. 21, the developing cartridge according to the present embodiment has a conductive section 210*j* made up of, for instance, a conductive resin material, at part of the non-driven-side bearing member 214*g*. As illustrated in FIG. 21 and FIG. 22, the conductive section 210*j* is integrally molded, for instance by double molding, with the non-driven-side bearing member 214*g*. Further, the conductive section 210*j* makes up part of a developing roller support section 214*g*1 of the non-driven-side bearing member 214*g*. That is, the open section outer peripheral face 210*d*6 of the developing roller 210*t* is configured to be in sliding contact with the developing roller support section 214*g*1 and with the developing roller sliding section 210*j*1 of the conductive section 210*j* that makes up part of the developing roller support section 214*g*1.

The conductive section 210*j* is disposed in such a manner that a distance can be secured that allows preventing leakage between the conductive section 210*j* and the photoconductive drum 207. The present embodiment is configured so that a distance of 1.0 mm or greater can be secured as a leakage prevention distance. Specifically, the conductive section 210*j* is disposed at a position on the side opposite that of the photoconductive drum 207, across the open section outer peripheral face 210*d*6, as illustrated in FIG. 22, to secure the above leakage prevention distance.

As illustrated in FIG. 20, the conductive section 210*j* has a body contact section 210*j*2, that is in pressure-contact with a developing bias power supply unit (not shown) of the image forming apparatus, and to which a predetermined developing bias is supplied from the body side. The developing bias is supplied from the developing bias power supply unit, not shown, to the conductive section 210*j*4, via the body contact section 210*j*2; the developing bias passes through the conductive section 210*j*4 and is supplied to the developing roller 210*t* from the developing roller sliding section 210*j*1. The body contact section 210*j*2 may be configured of a separate metallic member, or may be integrally formed out of the same conductive resin as that of the conductive section 210*j*4.

By virtue of the present embodiment, a power supply configuration can be formed that allows supplying developing bias to the developing roller 210*t* via the conductive section 210*j*3, while maintaining a predetermined leakage prevention distance with photoconductive drum 207. The conductive section 210*j* is integrally molded, by double molding or the like, with the non-driven-side bearing member 214*g*, and hence production costs can be reduced compared to those in a case where the conductive section is assembled using a separate member. It becomes therefore possible to provide, at a low cost, a configuration that allows supplying developing bias to the developing roller 210*t* stably and without adverse effects.

Embodiment 8

A developing cartridge, a process cartridge and an image forming apparatus according to Embodiment 8 of the present invention will be explained next with reference to FIG. 23. The characterizing feature of Embodiment 8 is the power supply configuration of developing bias to the developing roller 210*t*. Only features different from those of the above embodiments will be explained herein. Features that are not explained are identical to those of the above embodiments.

Figure 23:
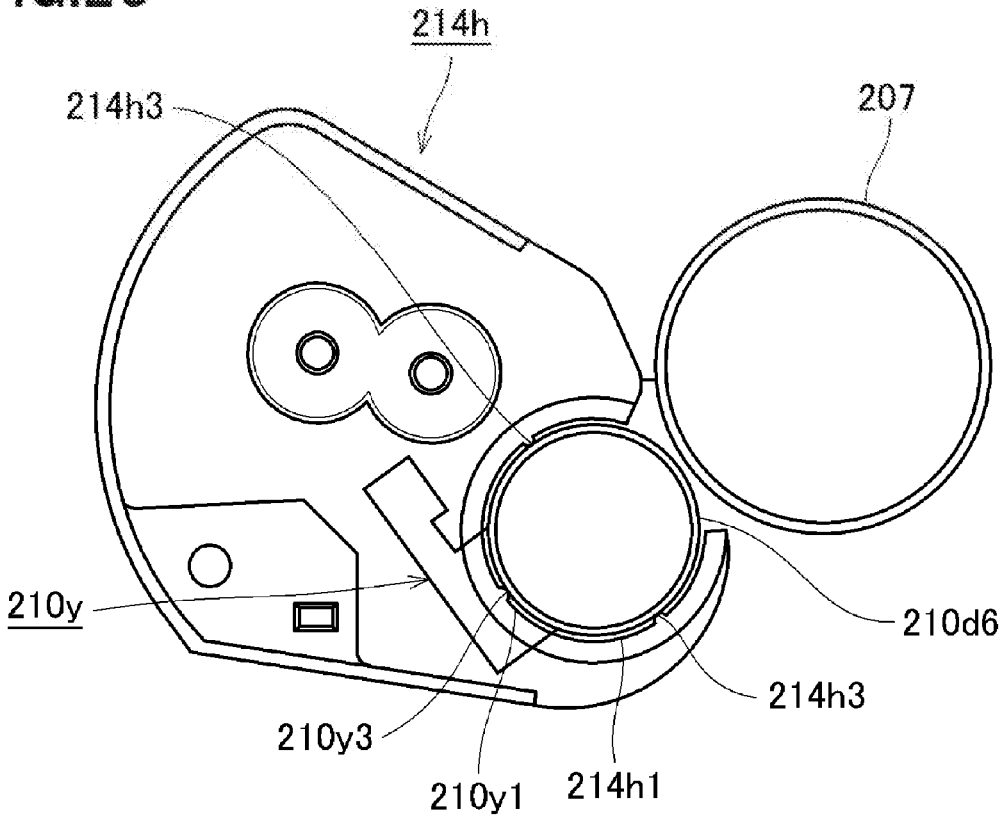
FIG. 23 is a schematic diagram illustrating the configuration of a developing cartridge according to Embodiment 8 of the present invention.

FIG. 23 is a schematic diagram illustrating a schematic configuration, on the interior of the developing cartridge, with the non-driven side of the developing cartridge according to the present embodiment viewed along the axial direction of the developing roller 210*t*. In FIG. 23 structures other than a non-driven-side bearing member 214*h*, the open section outer peripheral face 210*d*6 of the developing roller 210*t*, the photoconductive drum 207, and a conductive section 210*y* have been omitted. The developing cartridge of the present embodiment has a conductive section 210*y*, made up of for instance a conductive resin material, at part of the non-driven-side bearing member 214*h*, in a configuration identical to that of the non-driven-side bearing member 214*g* in Embodiment 7. The conductive section 210*y* has a body contact section 210*y*2 (not shown) to which a predetermined developing bias is supplied, from a body side, according to a configuration identical to that of the conductive section 210*j*.

In the present embodiment, the support configuration of the developing roller 210*t* by a developing roller support section 214*h*1 is such that the developing roller 210*t* is supported by a plurality of support sections having a protruding shape, and not a support section having a peripheral face corresponding to the open section outer peripheral face 210*d*6, such as the developing roller support section 214*g*1 of Embodiment 7. Specifically, the developing roller support section 214*h*1 has one protrusion 210*y*3 on a developing roller sliding section 210*y*1 of the conductive section 210*y*, and two protruding shapes 214*h*3 at portions where the developing roller sliding section 210*y*1 is absent. Specifically, the open section outer peripheral face 210*d*6 of the developing roller 210*t* is supported, at the developing roller support section 214*h*1, on three points, namely the two non-conductive protruding shapes 214*h*3 and the one conductive protrusion 210*y*3.

In the material distribution of the resin-molded conductive section 210*y*, a conductive material, such as carbon, contained in the conductive resin material aggregates readily, for geometric reasons, at the protrusion 210*y*3 of protruding shape. Therefore, conduction with the open section outer peripheral face 210*d*6 is facilitated at the protrusion 210*y*3 of the conductive section 210*y*. The conductive section 210*y* is disposed at a position on the side opposite that of the photoconductive drum 207, across the open section outer peripheral face 210*d*6, in such a manner that a distance (1.0 mm or greater) can be secured that allows preventing leakage between the conductive section 210*y* and the photoconductive drum 207.

By virtue of the present embodiment, a power supply configuration can be formed that allows supplying developing bias to the developing roller 210*t* via the conductive section 210*y*, while maintaining a predetermined leakage prevention distance with photoconductive drum 207. The conductive section 210*y* is integrally molded, by double molding or the like, with the non-driven-side bearing member 214*h*, and hence production costs can be reduced compared to those in a case where the conductive section is assembled using a separate member. Further, conduction between the conductive section 210*y* and the developing roller 210*t* can be made better by relying on a configuration where the open section outer peripheral face 210 is conductively supported by the protrusion 210*y*3. It becomes therefore possible to provide, at a low cost, a configuration that allows supplying developing bias to the developing roller 210*t* stably and without adverse effects.

Embodiment 9

A developing cartridge, a process cartridge and an image forming apparatus according to Embodiment 9 of the present invention will be explained next with reference to FIG. 24 to FIG. 29. In the present embodiment, a magnet member 210*h* is disposed at an inner cylinder section of a developing sleeve, which is the developing roller 210*d*. Only features different from those of the above embodiments will be explained herein. Features that are not explained are identical to those of the above embodiments.

Figure 24:
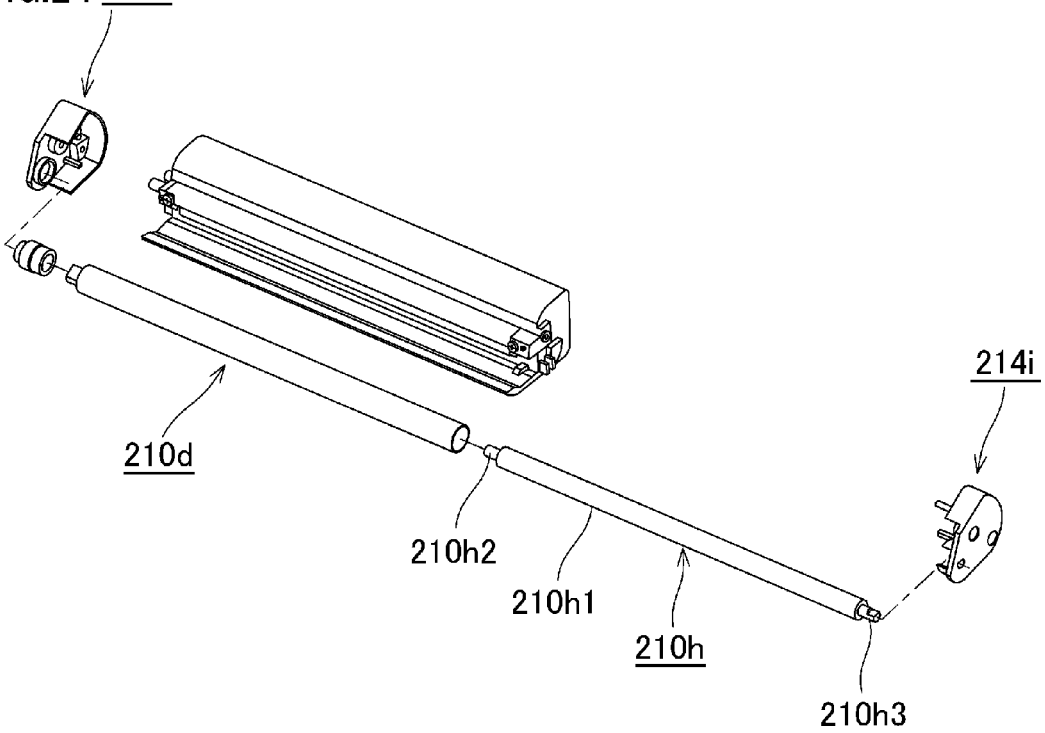
FIG. 24 is a perspective-view diagram of a developing cartridge according to Embodiment 9 of the present invention.
Figure 25:
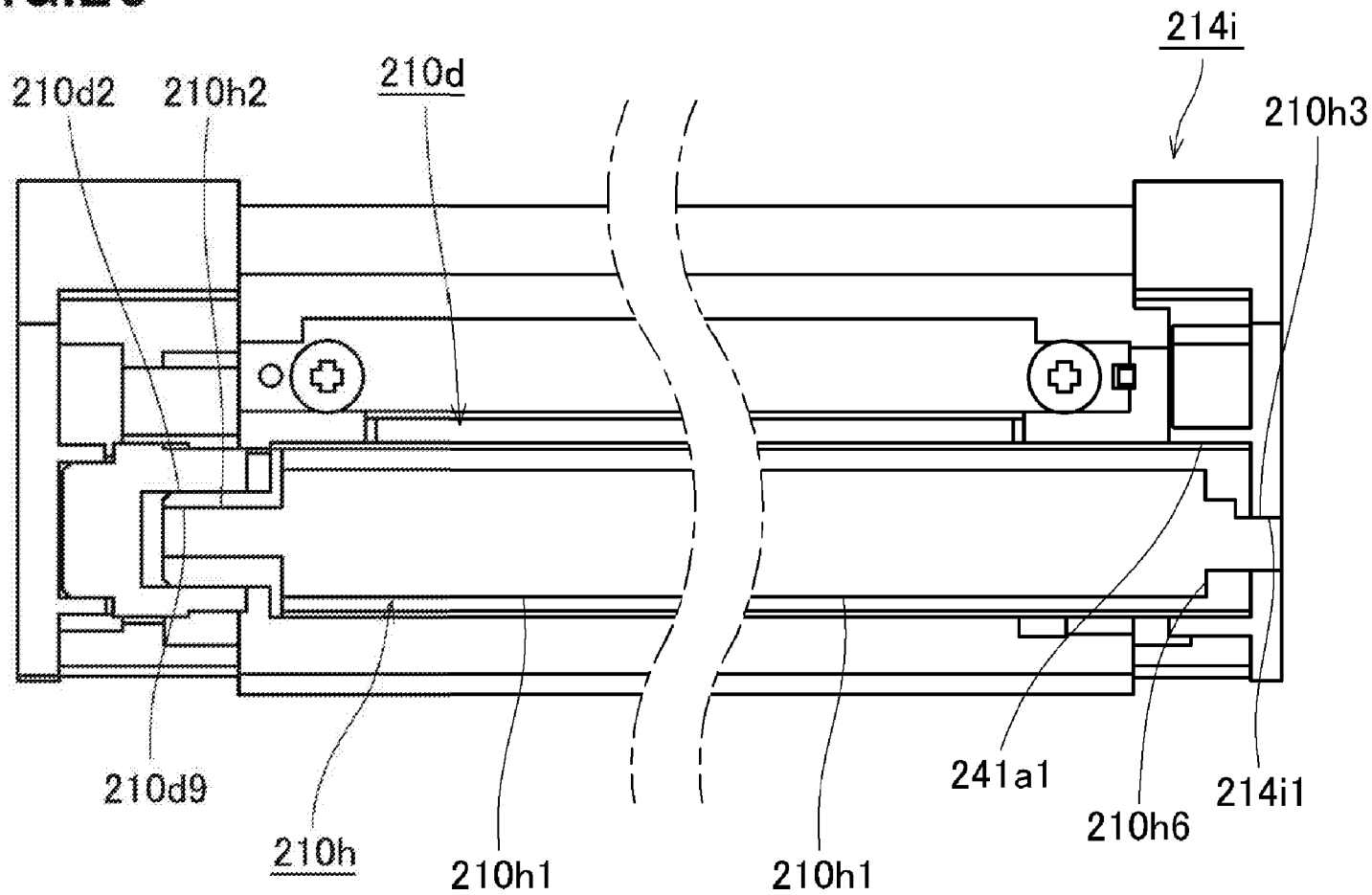
FIG. 25 is a schematic cross-sectional diagram of the developing cartridge according to Embodiment 9 of the present invention.

FIG. 24 is a perspective-view diagram illustrating, in an exploded view, the support configuration of the developing roller 210*d* in the developing cartridge of Embodiment 9 of the present invention. FIG. 25 is a schematic cross-sectional diagram illustrating the configuration in the vicinity of both ends, on the driven side and the non-driven side, of the developing cartridge in Embodiment 9 of the present invention. In the present embodiment, the developing roller 210*d* has enclosed therein a magnet member 210*h* that generates a magnetic field such that toner is constrained on account of magnetic forces. As a result, the toner that is supplied from the developer storing container 210*b*1 adheres to the surface of the developing roller 210*d*, on account of the magnetic force of the magnet member 210*h*, and is developed in accordance with a predetermined process described above.

As illustrated in FIG. 24, the magnet member 210*h* has, at a central portion thereof in the axial direction, a magnetic force generation region section 210*h*1 that generates a magnetic force. At the driven-side end in the axial direction, the magnet member 210*h* has a driven-side support section 210*h*2, the cross-sectional area of which in a cross-section viewed in the axial direction (cross-section perpendicular to the axial direction) is smaller than that of the magnetic force generation region section 210*h*1. At the non-driven-side end in the axial direction, the magnet member 210*h* has a non-driven-side support section 210*h*3, having a D cut shape, the cross-sectional area of which in a cross-section viewed in the axial direction is smaller than that of the magnetic force generation region section 210*h*1.

As illustrated in FIG. 25, the driven-side support section 210*h*2 of the magnet member 210*h* is supported on an engagement section inner peripheral section 210*d*9 at an inner peripheral section of the engagement section 210*d*2 of the developing roller 210*d*. The non-driven-side support section 210*h*3 of the magnet member 210*h* is fitted, at the D cut shape, to a magnet member fixing section 214*i*1 of a non-driven-side bearing member 214*i*, so that the magnet member 210*h* becomes as a result positioned, and supported, in the axial direction. Specifically, the magnet member 210*h* is provided, in the rotating developing roller 210*d*, in such a manner that the rotation of the magnet member 210*h* with respect to the developing frame 210*b* is restricted. As illustrated in FIG. 25, the magnet member 210*h* is configured in such a manner that a position of a non-driven-side magnetic force generation region end face 210*h*6 overlaps the developing roller support section 214*a*1 of the non-driven-side bearing member 214*i*, in the axial direction of the developing roller 210*d*.

Figure 26:
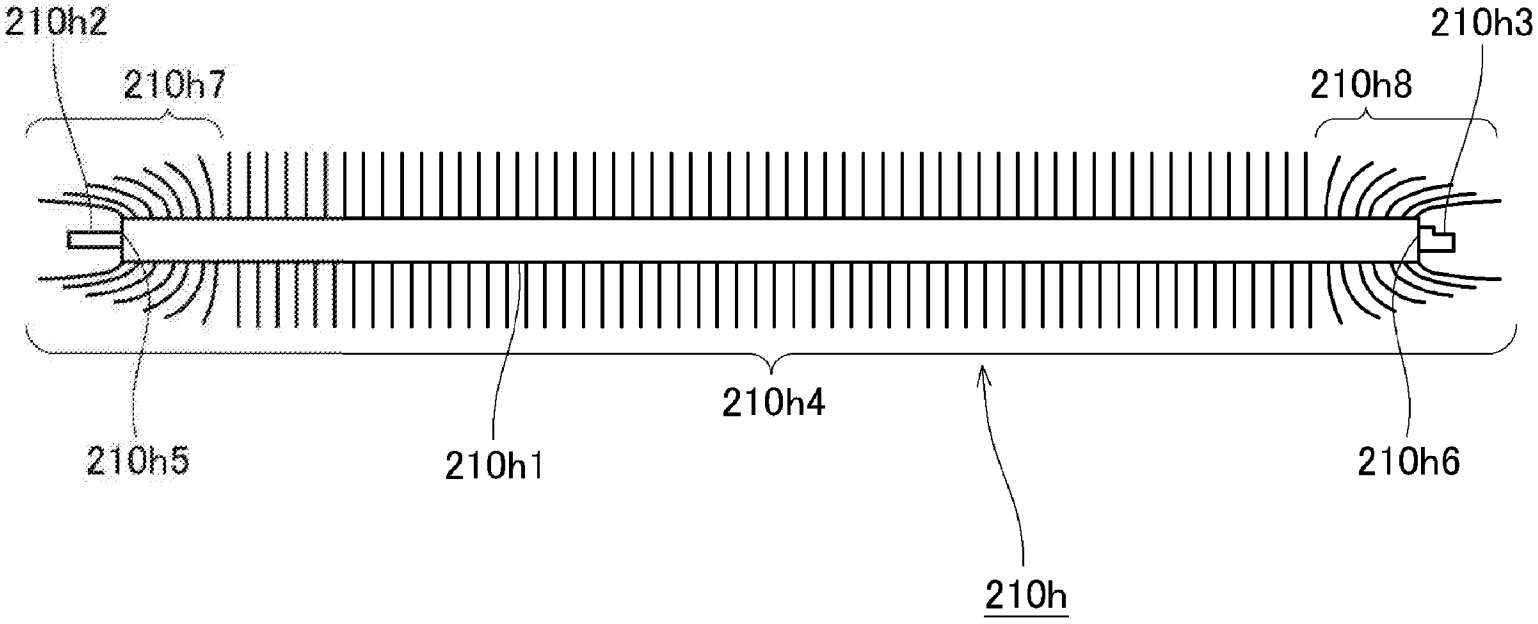
FIG. 26 is a schematic diagram illustrating a magnetic force state of the magnet member in Embodiment 9 of the present invention.

FIG. 26 is a schematic diagram illustrating a magnetic force state in the longitudinal direction of the magnet member 210*h*. The magnetic force generation region section 210*h*1 has a driven-side magnetic force generation region end face 210*h*5 at the driven-side end face, and the non-driven-side magnetic force generation region end face 210*h*6 at the non-driven-side end face. As illustrated in FIG. 26, magnetic force lines 210*h*4 of the magnet member 210*h* are formed so as to diverge in the vicinity of the driven-side magnetic force generation region end face 210*h*5 and the non-driven-side magnetic force generation region end face 210*h*6. A driven-side weak magnetic force section 210*h*7 and a non-driven-side weak magnetic force section 210*h*8, at which the intensity of the magnetic force is overall smaller than at the central portion in the axial direction, are formed at both axial-direction ends of the magnetic force generated by the magnetic force generation region section 210*h*1.

Figure 27:
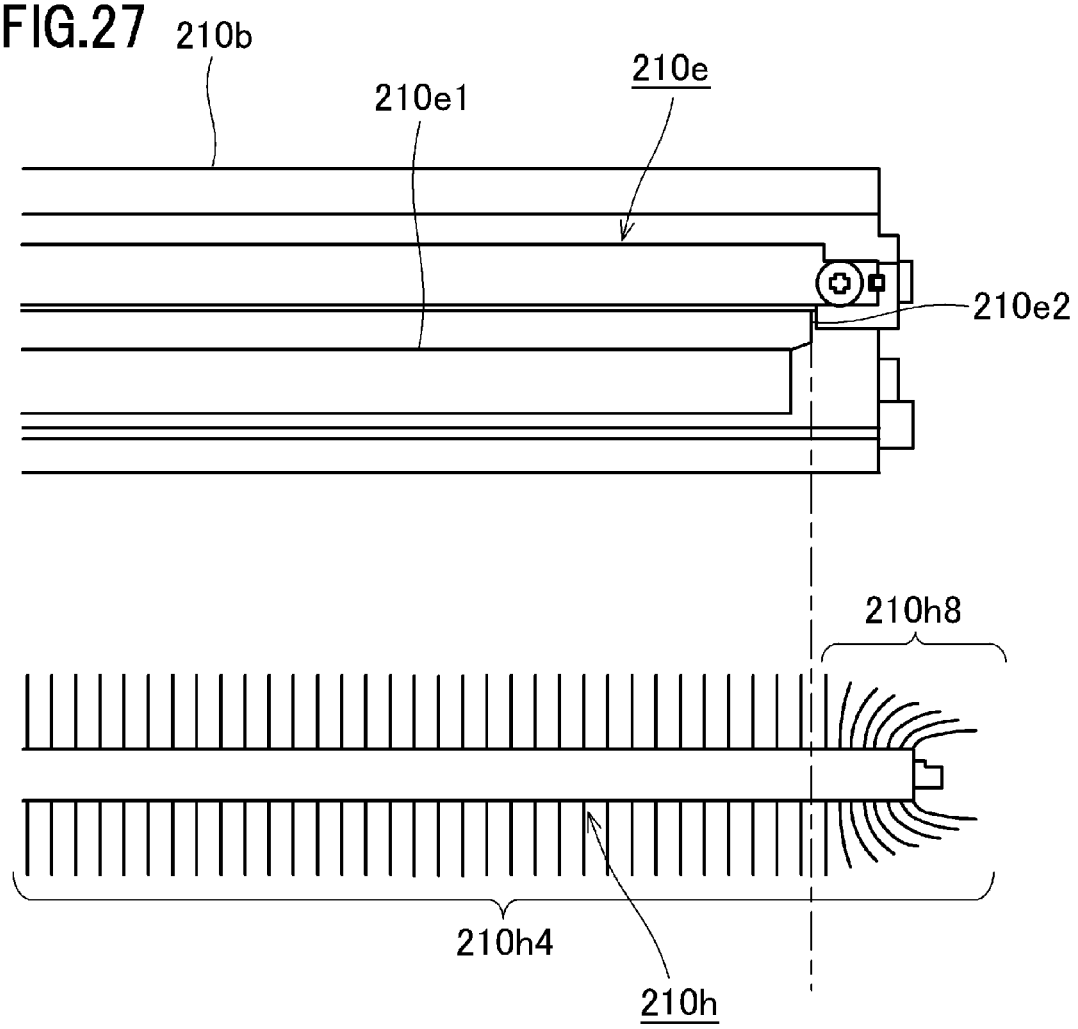
FIG. 27 is a schematic cross-sectional diagram of the developing cartridge according to Embodiment 9 of the present invention.

FIG. 27 is a schematic cross-sectional diagram illustrating the configuration of the non-driven side of the developing cartridge in the present embodiment, wherein the diagram illustrates the positional relationship between the magnet member 210*h* and the developing blade 210*e*, in the axial direction of the magnet member 210*h*. In FIG. 27, structures other than the developing frame 210*b*, the developing blade 210*e* and the magnet member 210*h* have been omitted. The developing blade 210*e* has a developer regulating section 210*e*1 that is in contact with the developing roller 210*d* and that regulates the layer thickness of the toner. The area over which the developer regulating section 210*e*1 of the developing blade 210*e* is present in the longitudinal direction of the process cartridge 100 constitutes herein an image formation region. In order to obtain good images stably, it is important that the amount of developer that is adhered to the developing roller 210*d* be constant in the longitudinal direction (axial direction) of the developing roller 210*d*. To that end, the magnetic force of the magnet member 210*h* must be stabilized over the area in which the developer regulating section 210*e*1 is present in the longitudinal direction of the developing blade 210*e*.

In the present embodiment, as illustrated in FIG. 27, the non-driven-side weak magnetic force section 210*h*8 is positioned outward, in the longitudinal direction, of a regulating section non-driven-side end face 210*e*2 of the developer regulating section 210*e*1. As a result, it becomes possible to stabilize the magnetic force in the longitudinal direction, on the non-driven side of the developer regulating section 210*e*1. The amount of toner that adheres can therefore be stably kept to a given amount, on the non-driven side of the developing roller 210*d*.

Figure 28:
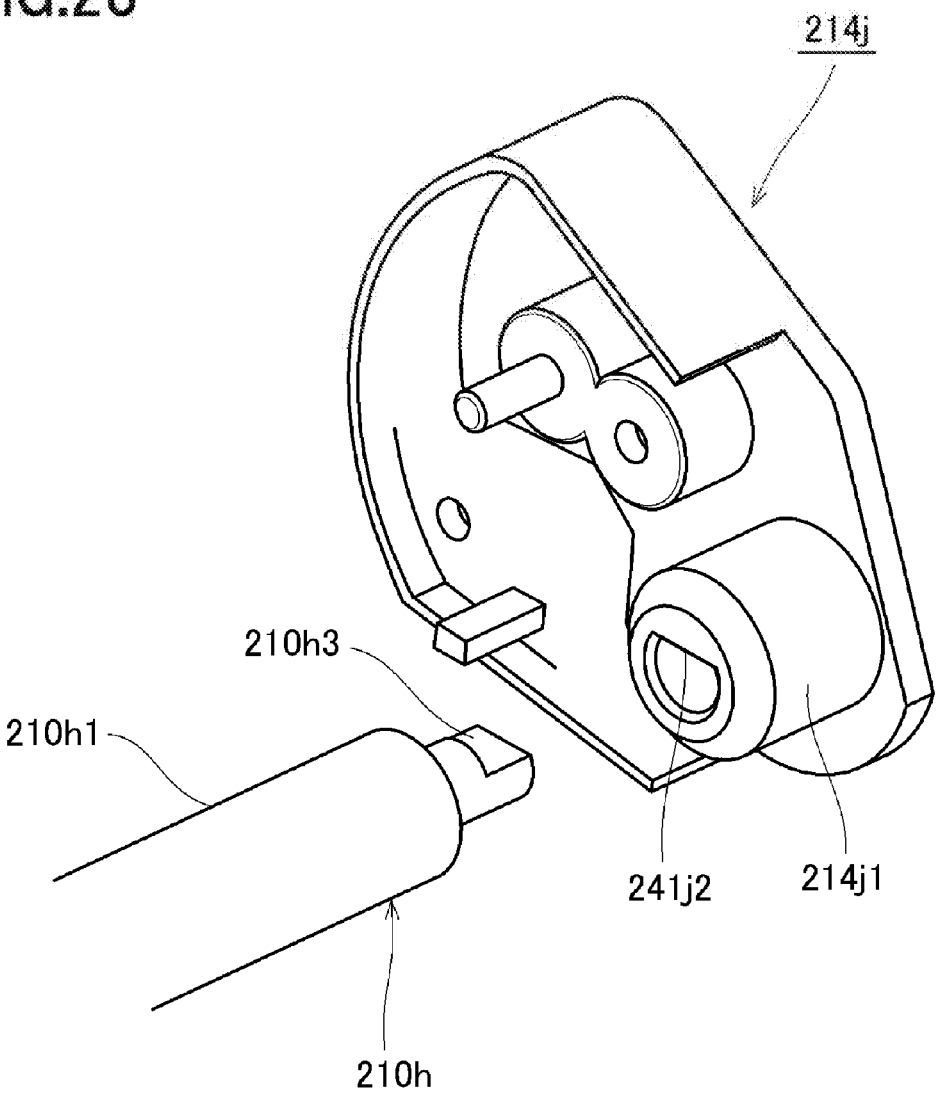
FIG. 28 is a perspective-view diagram illustrated in part of the configuration of a developing cartridge according to Comparative example 3.
Figure 29:
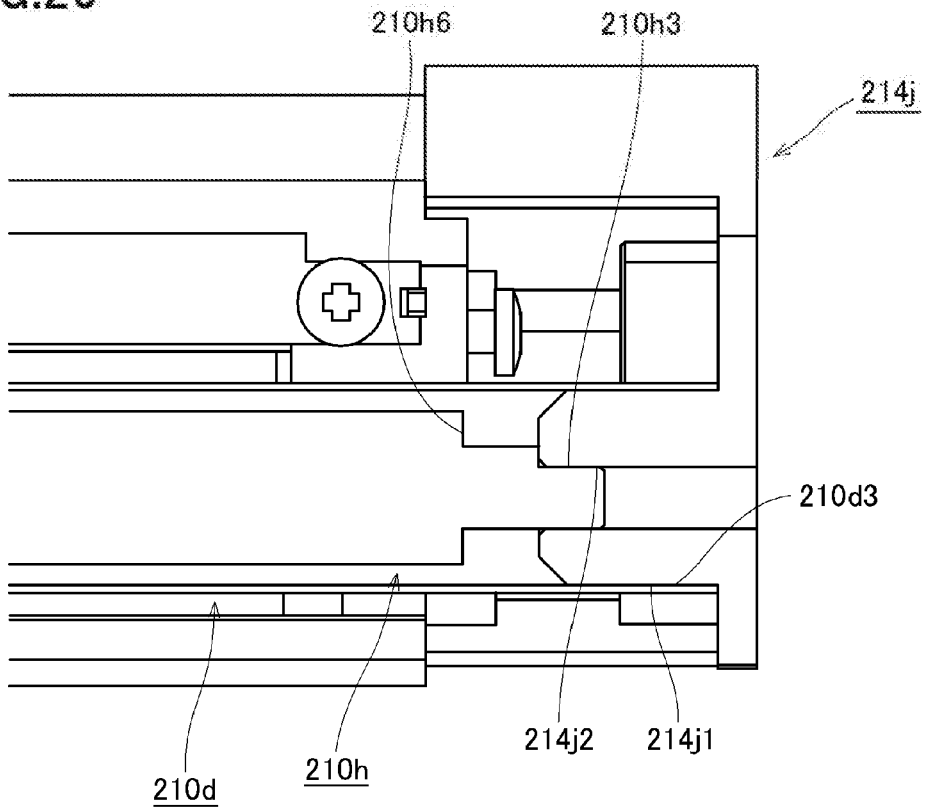
FIG. 29 is a schematic diagram of the developing cartridge according to Comparative example 3.

An explanation follows next, with reference to FIG. 28 and FIG. 29, on a configuration where the magnet member is disposed on the inner cylinder section of the cylindrical developing roller, in an instance (Comparative example 3) in which the configuration for supporting the inner peripheral face of the developing roller is different from that of the embodiment of the present invention that involves supporting the outer peripheral face of the developing roller. FIG. 28 is a perspective-view diagram illustrating, in an exploded view, a non-driven-side bearing member 214*j* and the periphery of the non-driven-side support section 210*h*3 of the magnet member 210*h* in Comparative example 3 of the present embodiment. FIG. 29 is a schematic cross-sectional diagram illustrating the configuration of the non-driven side of the developing cartridge in the present comparative example.

As illustrated in FIG. 28 and FIG. 29, the non-driven-side bearing member 214*j* in the present comparative example has a developing roller support section 214*j*1 that rotatably supports the open section 210*d*3, i.e. the inner peripheral face, of the developing roller 210*d*. The non-driven-side bearing member 214*j* has a magnet member fixing section 214*j*2 that fixes the magnet member 210*h*. The magnet member 210*h* is positioned and supported in the axial direction, through fitting, according to of a D cut shape, of the non-driven-side support section 210*h*3 with the magnet member fixing section 214*j*2.

In the configuration of the present comparative example, the developing roller support section 214*j*1 is inserted in the inner cylinder section of the developing roller 210*d*. Therefore, the position of the ends of the magnet member 210*h* in the longitudinal direction lie inward of the ends of the developing roller 210*d* by an extent proportional to the developing roller support section 214*j*1. In order to set the amount of toner that is adhered to the developing roller 210*d*, as described above, it is necessary to arrange the non-driven-side weak magnetic force section 210*h*8 of the magnet member 210*h*, outward, in the longitudinal direction, of the non-driven-side end 210*e*2 of the developing blade 210*e*. In order to realize this arrangement in the configuration of the present comparative example, it is necessary to arrange the developing roller support section 214*j*1 of the non-driven-side bearing member 214*j* of the present comparative example further outward, in the longitudinal direction, than the developing roller support section 214*a*1 of the non-driven-side bearing member 214*a* illustrated in FIG. 25. In the configuration of the present comparative example, therefore, the dimension of the developing cartridge 210 is larger, in the longitudinal direction, at least by the distance over which the open section 210*d*3 of the developing roller support section 214*j*1 is supported.

In the configuration of the present embodiment, the outer peripheral face of the non-driven-side end of the developing roller 210*d* is supported by relying on a configuration in which the magnet member 210*h* is enclosed in the cylindrical developing roller 210*d*. Further, the non-driven-side magnetic force generation region end face 210*h*6 of the magnet member 210*h* is disposed so as to overlap with the developing roller support section 214*a*1 of the non-driven-side bearing member 214*i*, in the axial direction of the magnet member 210*h*. Such a configuration allows arranging the non-driven-side weak magnetic force section 210*h*8 of the magnet member 210*h* so as not to overlap the image formation region in the longitudinal direction, without increasing the longitudinal dimension of the process cartridge 100. A process cartridge 100 can be provided as a result in which good images can be formed through suppression of the occurrence of image adverse effects such as image density non-uniformity in the longitudinal direction.

The outer peripheral face support configuration of the developing roller in the above embodiments may be adopted not only on the non-driven side, but also on the driven side. The configurations of the above embodiments can be combined with one another, as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-124478, filed on Jun. 17, 2014, which is hereby incorporated by reference herein in its entirety.

What is claimed is:

1. A developing cartridge comprising:

a cylindrical developing roller that develops an electrostatic latent image that is formed on an image bearing member;

a developer regulating member that regulates a thickness of developer carried on the developing roller; and a frame that rotatably supports the developing roller and supports the developer regulating member, wherein the frame has a developing roller support section that rotatably supports an outer peripheral surface of at least one end of the developing roller, wherein the developing roller support section has a shape such that part of the developing roller support section facing to the image bearing member is cut away, wherein the frame is provided with a conductive section that is formed of a conductive resin that transmits developing bias to the developing roller through contact with the outer peripheral surface of the developing roller, and wherein the conductive section is integrally formed with the frame in such a manner that a predetermined distance for suppressing leakage of developing bias is secured between the conductive section and the image bearing member; and wherein the conductive section has a first contact portion, which is formed on a surface of the developing roller support section, and which conductively contacts the outer peripheral surface of the developing roller, and a second contact portion, which is exposed on an outer surface of the frame, and which conductively communicates with the first contact portion.

2. A developing cartridge comprising:

a developing roller that develops an electrostatic latent image that is formed on an image bearing member;

a developer regulating member that regulates a thickness of developer carried on the developing roller; and a frame that rotatably supports the developing roller and supports the developer regulating member, wherein the frame has a developing roller support section that rotatably supports an outer peripheral surface of at least one end of the developing roller, wherein the frame is provided with a conductive section that is formed of a conductive resin and that is formed integrally with the frame, and wherein the conductive section has a first contact portion, which is formed on a surface of the developing roller support section, and which is conductively communicated with the developing roller by contacting the outer peripheral surface of the developing roller, and a second contact portion, which is exposed on an outer surface of the frame, and which conductively communicates with the first contact portion.

3. The developing cartridge according to the claim 2, wherein the developing roller support section has a shape such that part of the developing roller support section facing the image bearing member is cut away.

4. The developing cartridge according to claim 2, wherein the developing roller includes (i) a developer transport portion that is provided at a center portion in an axial direction of the developing roller for transporting developer and (ii) a mounting portion that is provided at an end portion in the axial direction of the developing roller for mounting the developer roller to the frame by conductively contacting the mounting portion with the developing roller support section, and wherein the radial dimensions of the developer transport portion and the mounting portion of the developing roller are essentially same such that there is no difference in level between an outer surface of the developer transport portion and an outer surface of the mounting portion.

* * * * *